US009078063B2

(12) United States Patent
Loeppert et al.

(10) Patent No.: US 9,078,063 B2
(45) Date of Patent: Jul. 7, 2015

(54) MICROPHONE ASSEMBLY WITH BARRIER TO PREVENT CONTAMINANT INFILTRATION

(71) Applicant: Knowles Electronics, LLC, Itasca, IL (US)

(72) Inventors: Peter V. Loeppert, Durand, IL (US); Ryan M. McCall, San Jose, CA (US); Daniel Giesecke, West Chicago, IL (US); Sandra F. Vos, East Dundee, IL (US); John B. Szczech, Schaumburg, IL (US); Sung Bok Lee, Chicago, IL (US); Peter Van Kessel, Downers Grove, IL (US)

(73) Assignee: KNOWLES ELECTRONICS, LLC, Itasca, IL (US)

( * ) Notice: Subject to any disclaimer, the term of this patent is extended or adjusted under 35 U.S.C. 154(b) by 0 days.

(21) Appl. No.: 13/960,392

(22) Filed: Aug. 6, 2013

(65) Prior Publication Data

US 2014/0044297 A1 Feb. 13, 2014

Related U.S. Application Data

(60) Provisional application No. 61/681,685, filed on Aug. 10, 2012.

(51) Int. Cl.
*H04R 1/04* (2006.01)
*H04R 1/08* (2006.01)

(52) U.S. Cl.
CPC ..... *H04R 1/04* (2013.01); *H04R 1/086* (2013.01); *H04R 2201/003* (2013.01)

(58) Field of Classification Search
CPC ..... H04R 1/04; H04R 1/086; H04R 2201/003
USPC ..... 381/355, 369, 174, 175; 257/416, 254, 257/678, 685, 686; 438/50–53
See application file for complete search history.

(56) References Cited

U.S. PATENT DOCUMENTS

| | | | |
|---|---|---|---|
| 3,192,086 | A | 6/1965 | Gyurk |
| 3,381,773 | A | 5/1968 | Schenkel |
| 3,539,735 | A | 11/1970 | Marchand |
| 3,567,844 | A | 3/1971 | Krcmar |

(Continued)

FOREIGN PATENT DOCUMENTS

| | | |
|---|---|---|
| CA | 2315417 A1 | 2/2001 |
| DE | 10303263 | 8/2004 |

(Continued)

OTHER PUBLICATIONS

International Search Report and Written Opinion for PCT/US2013/054139, dated Nov. 25, 2013, 34 pages.

(Continued)

*Primary Examiner* — Tuan D Nguyen
(74) *Attorney, Agent, or Firm* — Fitch, Even, Tabin & Flannery LLP

(57) ABSTRACT

A microphone assembly includes a cover, a base coupled to the cover, a microelectromechanical system (MEMS) device disposed on the base. An opening is formed in the base and the MEMS device is disposed over the opening. The base includes a barrier that extends across the opening and is porous to sound. The remaining portions of the base do not extend across the opening.

41 Claims, 35 Drawing Sheets

(56) References Cited

U.S. PATENT DOCUMENTS

| | | | |
|---|---|---|---|
| 3,735,209 | A | 5/1973 | Saddler |
| 3,735,211 | A | 5/1973 | Kapnias |
| 4,127,840 | A | 11/1978 | House |
| 4,222,277 | A | 9/1980 | Kurtz et al. |
| 4,277,814 | A | 7/1981 | Giachino et al. |
| 4,314,226 | A | 2/1982 | Oguro et al. |
| 4,430,593 | A | 2/1984 | Gohlert et al. |
| 4,456,796 | A | 6/1984 | Nakagawa et al. |
| 4,533,795 | A | 8/1985 | Baumhauer et al. |
| 4,558,184 | A | 12/1985 | Busch-Vishniac et al. |
| 4,628,740 | A | 12/1986 | Ueda et al. |
| 4,643,935 | A | 2/1987 | McNeal et al. |
| 4,691,363 | A | 9/1987 | Khanna |
| 4,737,742 | A | 4/1988 | Takoshima et al. |
| 4,776,019 | A | 10/1988 | Miyatake |
| 4,825,335 | A | 4/1989 | Wilner |
| 4,891,686 | A | 1/1990 | Krausse, III |
| 4,908,805 | A | 3/1990 | Sprenkels et al. |
| 4,910,840 | A | 3/1990 | Sprenkels et al. |
| 4,984,268 | A | 1/1991 | Brown et al. |
| 5,099,396 | A | 3/1992 | Barz et al. |
| 5,101,543 | A | 4/1992 | Cote et al. |
| 5,101,665 | A | 4/1992 | Mizuno |
| 5,146,435 | A | 9/1992 | Bernstein |
| 5,151,763 | A | 9/1992 | Marek et al. |
| 5,153,379 | A | 10/1992 | Guzuk et al. |
| 5,159,537 | A | 10/1992 | Okano |
| 5,178,015 | A | 1/1993 | Loeppert et al. |
| 5,202,652 | A | 4/1993 | Tabuchi et al. |
| 5,216,278 | A | 6/1993 | Lin et al. |
| 5,237,235 | A | 8/1993 | Cho et al. |
| 5,241,133 | A | 8/1993 | Mullen, III et al. |
| 5,252,882 | A | 10/1993 | Yatsuda |
| 5,257,547 | A | 11/1993 | Boyer |
| 5,313,371 | A | 5/1994 | Knecht et al. |
| 5,357,807 | A | 10/1994 | Guckel et al. |
| 5,394,011 | A | 2/1995 | Yamamoto et al. |
| 5,400,949 | A | 3/1995 | Hirvonen et al. |
| 5,408,731 | A | 4/1995 | Berggvist et al. |
| 5,449,909 | A | 9/1995 | Kaiser et al. |
| 5,452,268 | A | 9/1995 | Bernstein |
| 5,459,368 | A | 10/1995 | Onishi et al. |
| 5,477,008 | A | 12/1995 | Pasqualoni et al. |
| 5,490,220 | A | 2/1996 | Loeppert |
| 5,506,919 | A | 4/1996 | Roberts |
| 5,531,787 | A | 7/1996 | Lesinski et al. |
| 5,545,912 | A | 8/1996 | Ristic et al. |
| 5,592,391 | A | 1/1997 | Muyshondt et al. |
| 5,593,926 | A | 1/1997 | Fujihira |
| 5,611,129 | A | 3/1997 | Yoshimoto et al. |
| 5,659,195 | A | 8/1997 | Kaiser et al. |
| 5,712,523 | A | 1/1998 | Nakashima et al. |
| 5,736,783 | A | 4/1998 | Wein et al. |
| 5,740,261 | A | 4/1998 | Loeppert et al. |
| 5,748,758 | A | 5/1998 | Measco, Jr. et al. |
| 5,761,053 | A | 6/1998 | King et al. |
| 5,776,798 | A | 7/1998 | Quan et al. |
| 5,783,748 | A | 7/1998 | Otani |
| 5,789,679 | A | 8/1998 | Koshimizu et al. |
| 5,818,145 | A | 10/1998 | Fukiharu |
| 5,831,262 | A | 11/1998 | Greywall et al. |
| 5,838,551 | A | 11/1998 | Chan |
| 5,852,320 | A | 12/1998 | Ichihashi |
| 5,870,482 | A | 2/1999 | Loeppert et al. |
| 5,886,876 | A | 3/1999 | Yamaguchi |
| 5,889,872 | A | 3/1999 | Sooriakumar et al. |
| 5,895,229 | A | 4/1999 | Carney et al. |
| 5,898,574 | A | 4/1999 | Tan et al. |
| 5,901,046 | A | 5/1999 | Ohta et al. |
| 5,923,995 | A | 7/1999 | Kao et al. |
| 5,939,784 | A | 8/1999 | Glenn |
| 5,939,968 | A | 8/1999 | Nguyen et al. |
| 5,949,305 | A | 9/1999 | Shimamura |
| 5,976,912 | A | 11/1999 | Fukutomi et al. |
| 5,977,626 | A | 11/1999 | Wang et al. |
| 5,981,314 | A | 11/1999 | Glenn et al. |
| 5,999,821 | A | 12/1999 | Kaschke |
| 6,003,381 | A | 12/1999 | Kato |
| 6,012,335 | A | 1/2000 | Bashir et al. |
| 6,052,464 | A | 4/2000 | Harris et al. |
| 6,066,882 | A | 5/2000 | Kato |
| 6,078,245 | A | 6/2000 | Fritz et al. |
| 6,088,463 | A | 7/2000 | Rombach et al. |
| 6,093,972 | A | 7/2000 | Carney et al. |
| 6,108,184 | A | 8/2000 | Minervini et al. |
| 6,117,705 | A | 9/2000 | Glenn et al. |
| 6,118,881 | A | 9/2000 | Quinlan et al. |
| 6,119,920 | A | 9/2000 | Guthrie et al. |
| 6,136,419 | A | 10/2000 | Fasano et al. |
| 6,140,144 | A | 10/2000 | Najafi et al. |
| 6,147,876 | A | 11/2000 | Yamaguchi et al. |
| 6,150,748 | A | 11/2000 | Fukiharu |
| 6,157,546 | A | 12/2000 | Petty et al. |
| 6,163,071 | A | 12/2000 | Yamamura |
| 6,178,249 | B1 | 1/2001 | Hietanen et al. |
| 6,191,928 | B1 | 2/2001 | Rector et al. |
| 6,201,876 | B1 | 3/2001 | Niemi et al. |
| 6,228,676 | B1 | 5/2001 | Glenn et al. |
| 6,242,802 | B1 | 6/2001 | Miles et al. |
| 6,262,477 | B1 | 7/2001 | Mahulikar et al. |
| 6,282,072 | B1 | 8/2001 | Minervini et al. |
| 6,282,781 | B1 | 9/2001 | Gotoh et al. |
| 6,308,398 | B1 | 10/2001 | Beavers |
| 6,324,067 | B1 | 11/2001 | Nishiyama |
| 6,324,907 | B1 | 12/2001 | Halteren et al. |
| 6,339,365 | B1 | 1/2002 | Kawase et al. |
| 6,352,195 | B1 | 3/2002 | Guthrie et al. |
| 6,388,887 | B1 | 5/2002 | Matsumoto et al. |
| 6,401,542 | B1 | 6/2002 | Kato |
| 6,403,881 | B1 | 6/2002 | Hughes |
| 6,404,100 | B1 | 6/2002 | Chujo et al. |
| 6,428,650 | B1 | 8/2002 | Chung |
| 6,437,412 | B1 | 8/2002 | Higuchi et al. |
| 6,439,869 | B1 | 8/2002 | Seng et al. |
| 6,441,503 | B1 | 8/2002 | Webster |
| 6,472,724 | B1 | 10/2002 | Matsuzawa et al. |
| 6,479,320 | B1 | 11/2002 | Gooch |
| 6,483,037 | B1 | 11/2002 | Moore et al. |
| 6,512,834 | B1 | 1/2003 | Banter et al. |
| 6,521,482 | B1 | 2/2003 | Hyoudo et al. |
| 6,522,762 | B1 | 2/2003 | Mullenborn et al. |
| 6,526,653 | B1 | 3/2003 | Glenn et al. |
| 6,534,340 | B1 | 3/2003 | Karpman et al. |
| 6,594,369 | B1 | 7/2003 | Une |
| 6,621,392 | B1 | 9/2003 | Volant et al. |
| 6,664,709 | B2 | 12/2003 | Irie |
| 6,675,471 | B1 | 1/2004 | Kimura et al. |
| 6,781,231 | B2 | 8/2004 | Minervini |
| 6,859,542 | B2 | 2/2005 | Johannsen et al. |
| 6,876,052 | B1 | 4/2005 | Tai |
| 6,928,718 | B2 | 8/2005 | Carpenter |
| 6,936,918 | B2 | 8/2005 | Harney et al. |
| 6,962,829 | B2 | 11/2005 | Glenn et al. |
| 7,003,127 | B1 | 2/2006 | Sjursen et al. |
| 7,080,442 | B2 | 7/2006 | Kawamura et al. |
| 7,092,539 | B2 | 8/2006 | Sheplak et al. |
| 7,142,682 | B2 | 11/2006 | Mullenborn et al. |
| 7,166,910 | B2 | 1/2007 | Minervini |
| 7,215,223 | B2 | 5/2007 | Hattanda et al. |
| 7,221,767 | B2 | 5/2007 | Mullenborn et al. |
| 7,242,089 | B2 | 7/2007 | Minervini |
| 7,280,855 | B2 | 10/2007 | Hawker et al. |
| 7,381,589 | B2 | 6/2008 | Minervini |
| 7,382,048 | B2 | 6/2008 | Minervini |
| 7,434,305 | B2 | 10/2008 | Minervini |
| 7,436,054 | B2 | 10/2008 | Zhe |
| 7,439,616 | B2 | 10/2008 | Minervini |
| 7,501,703 | B2 | 3/2009 | Minervini |
| 7,537,964 | B2 | 5/2009 | Minervini |
| RE40,781 | E | 6/2009 | Johannsen et al. |
| 7,927,927 | B2 | 4/2011 | Quan et al. |
| 8,018,049 | B2 | 9/2011 | Minervini |
| 8,103,025 | B2 | 1/2012 | Mullenborn et al. |
| 8,121,331 | B2 | 2/2012 | Minervini |

(56) References Cited

U.S. PATENT DOCUMENTS

| | | | |
|---|---|---|---|
| 2002/0048839 | A1 | 4/2002 | Miller et al. |
| 2002/0067663 | A1 | 6/2002 | Loeppert et al. |
| 2002/0102004 | A1 | 8/2002 | Minervini |
| 2003/0052404 | A1 | 3/2003 | Thomas |
| 2003/0133588 | A1 | 7/2003 | Pedersen |
| 2004/0032705 | A1 | 2/2004 | Ma |
| 2004/0120540 | A1 | 6/2004 | Mullenborn et al. |
| 2004/0184632 | A1 | 9/2004 | Minervini |
| 2005/0018864 | A1 | 1/2005 | Minervini |
| 2005/0069164 | A1 | 3/2005 | Muthuswamy et al. |
| 2005/0185812 | A1 | 8/2005 | Minervini |
| 2005/0218488 | A1 | 10/2005 | Matsuo |
| 2006/0157841 | A1 | 7/2006 | Minervini |
| 2006/0177085 | A1 | 8/2006 | Izuchi et al. |
| 2007/0189568 | A1 | 8/2007 | Wilk et al. |
| 2007/0295663 | A1 | 12/2007 | Iraneta |
| 2008/0247585 | A1 | 10/2008 | Leidl et al. |
| 2010/0264499 | A1 | 10/2010 | Goodelle et al. |
| 2011/0096945 | A1 | 4/2011 | Furst et al. |

FOREIGN PATENT DOCUMENTS

| | | | |
|---|---|---|---|
| EP | 0 077 615 | A1 | 4/1983 |
| EP | 0 534 251 | A1 | 3/1993 |
| EP | 0 682 408 | A1 | 11/1995 |
| EP | 0 774 888 | A2 | 5/1997 |
| FI | 981413 | A | 12/1999 |
| JP | 63275926 | | 11/1988 |
| JP | 01169333 | | 7/1989 |
| JP | 07-099420 | | 4/1995 |
| JP | 09-107192 | | 4/1997 |
| JP | 09-306934 | A | 11/1997 |
| JP | 09-318650 | | 12/1997 |
| JP | 10-062282 | A | 3/1998 |
| JP | 2000-165999 | A | 6/2000 |
| JP | 2000-199725 | A | 7/2000 |
| JP | 2000-277970 | A | 10/2000 |
| JP | 2000-316042 | | 11/2000 |
| JP | 2000-340687 | A | 12/2000 |
| JP | 2001-102469 | A | 4/2001 |
| JP | 2001-308217 | A | 11/2001 |
| JP | 2002-324873 | A | 11/2002 |
| JP | 2002-334951 | A | 11/2002 |
| JP | 2005-235377 | A | 9/2005 |
| JP | 2006-283561 | A | 10/2006 |
| JP | 2010021225 | A | 1/2010 |
| WO | 00/42636 | A2 | 7/2000 |
| WO | 01/19133 | A1 | 3/2001 |
| WO | 01/20948 | A2 | 3/2001 |
| WO | 01/41497 | A1 | 6/2001 |
| WO | 02/15636 | A2 | 2/2002 |
| WO | 02/45463 | A2 | 6/2002 |
| WO | 2006/020478 | A1 | 2/2006 |
| WO | 2006/061058 | A1 | 6/2006 |

OTHER PUBLICATIONS

Applied Porous Technologies, Inc., "Metal Filter Products and the LC System," p. 1-4, 2004.
Mott Corporation, "Porous Metal Frits in Liquid Chromatography," p. 1-5, printed Jun. 2, 2011.
U.S. Appl. No. 60/209,692, filed Jun. 6, 2000, Carpenter.
U.S. Appl. No. 60/450/569, filed Feb. 28, 2003, Minervini.
U.S. Appl. No. 09/886,854, filed Jun. 21, 2001, Minervini.
U.S. Appl. No. 10/921,747, filed Aug. 19, 2004, Minervini.
U.S. Appl. No. 60/253,543, filed Nov. 29, 2000, Minervini.
U.S. Appl. No. 11/741,881, filed Apr. 30, 2007, Minervini.
Grieg, William, "Integrated Circuit Packaging, Assembly and Interconnections" (2007).
"Pressure Transducer Handbook," pp. 4-2 to 4-5, 12-1 to 12-5, National Semiconductor Corp., USA (1977).
Rosenberger, M.E., "Absolute Pressure Transducer for Turbo Application", pp. 77-79 (1983).
Smith, K., An Inexpensive High Frequency High Power VLSI Chip Carrier, IEPS.
Card, D., How ETA Chose to Make a Megaboard for its Supercomputer, pp. 50-52, Electron. Bus. (1988).
Speerschneider, C.F. et al., "Solder Bump Reflow Tape Automated Bonding", pp. 7-12, Proceedings 2nd ASM International Electronic Materials and Processing Congress (1989).
Tummala and Rymaszewski, "Microelectronics Packaging Handbook" (1989).
Minges, Merrill, L., "Electronics Materials Handbook, vol. 1 Packaging" (1989).
Pecht, Michael G., "Handbook of Electronic Package Design" (1991).
Petersen, Kurt et al., "Silicon Accelerometer Family; Manufactured for Automotive Applications" (1992).
Gilleo, Ken, "Handbook of Flexible Circuits" (1992).
Scheeper, P.R. et al., "A Review of Silicon Microphones", Sensor and Actuators Actuators, A 44, pp. 1-11 (1994).
Lau, John, ed., "Ball Grid Array Technology", McGraw Hill, Inc., USA (1995).
Khadpe, S., "Worldwide Activities in Flip Chip, BGA and TAB Technologies and Markets", pp. 290-293, Proceedings 1995 International Flip Chip, Ball Grid Array, TAB and Advanced Packaging Symposium (1995).
Alvarez, E. and Amkor Technology, Inc., "CABGA Optional Process Description" (Apr. 1997).
Dizon, C. and Amkor Technology, Inc., "CABGA Control Plan" (Dec. 1997).
Bever, T. et al., "BICMOS Compatible Silicon Microphone Packaged as Surface Mount Device", Sensors Expo (1999).
Torkkeli, Altti et al., "Capacitive Silicon Microphone," Physica Scripta vol. T79, pp. 275-278 (1999).
Pecht et al., "Electronic Packaging Materials and their Properties" (1999).
Premachandran, C.S. et al,, "Si-based Microphone Testing Methodology and Noise Reduction," Proceedings of SPIE, vol. 4019 (2000).
Torkkeli, Altti et al., "Capacitive microphone with low-stress polysilicon membrane and high-stress polysilicon backplate," Sensors and Actuators (2000).
"Harper, Charles ed., McGraw Hill, "Electronic Packaging and Interconnection Handbook" (2000)".
JEDEC Standard Terms, Definitions, and Letter Symbols for Microelectronic Devices (2000).
Institute of Electrical and Electronics Engineers, IEEE 100 The Authoritative Dictionary of IEEE Standards Terms Seventh Edition (2000).
Arnold, David Patrick, "A MEMS-Based Directional Acoustic Array for Aeoacoustic Measurements," Master's Thesis, University of Florida (2001).
Henning, Albert K. et al., "Microfluidic MEMS for Semiconductor Processing," IEEE Transaction on Components, Packaging, & Mfg. Tech., Part B, pp. 329-337, vol. 21, No. 4 (Nov. 1998).
Giasolli, Robert, "MEMS Packaging Introduction" (Nov. 2000).
Gale, Bruce K., "MEMS Packaging," Microsystems Principles (Oct. 2001).
Amkor Technology, Inc., "Control Plan—CABGA" (Apr. 2012).
Puttlitz & Totta, "Area Array Interconnection Handbook" (2001).
International Search Report for Application No. PCT/US05/021276 (Oct. 21, 2005).
European Search Report for Application No. 07702957.4 (Jul. 19, 2007).
Chung, K., et al., "Z-Axis Conductive Adhesives for Fine Pitch Interconnections", ISHM Proceedings, pp. 678-689 (1992).
Masuda, N., IEEE/CHMT Japan IEMT Symposium, pp. 55-58, (1989).
Kristiansen, H. et al., "Fine Pitch Connection of Flexible Circuits to Rigid Substrates Using Non-Conductive Epoxy Adhesive", IEPS, pp. 759-773 (1991).
Sakuma, K., et al., "Chip on Glass Technology with Standard Aluminized IC Chip", ISHM, pp. 250-256 (1990).
Katopis, G.A., "Delta-I Noise Specification for a High Performance Computing 'Machine'", Proc. IEEE, pp. 1405-1415 (1985).

(56) References Cited

OTHER PUBLICATIONS

Davis, E.M., et al., "Solid Logic Technology: Versatile High-Performance Microelectronics", IBM J. Res. Devel., 8(2), pp. 102-114 (1964).
Lloyd, R.H.F., "ASLT: An Extension of Hybrid-Miniaturization Techniques", IBM J. Res. Develop., 11(4), pp. 86-92 (1967).
Fox, P.E,. et al., "Design of Logic-Circuit Technology for IBM System 370 Models 145 and 155", IBM J. Res. Devel. 15(2), pp. 384-390 (1971).
Gedney, R.W., "Trends in Packaging Technology", 16th Annual Proceedings of Reliability Physics, pp. 127-129 (1978).
Schwartz, B. et al., "Ceramics and the Micromodule", RCA Eng., 5(4), p. 56-58 (1960).
Lomeson, .R.B, "High Technology Microcircuit Packaging", International Electronic Packaging Society Proceedings, pp. 498-503 (1982).
Balde, J.W., "Status and Prospects of Surface Mount Technology", Solid State Technol., 29(6), pp. 99-103 (1986).
Lau, John, "Chip Scale Package Design, Materials, Process, Reliability, and Applications", McGraw-Hill(1999).
Notice of Investigation, Inv. No. 337-TA-629, in the Matter of "Certain Silicon Microphone Packages and Products Containing the Same", United States International Trade Commission, issued Jan. 3, 2008.
Arnold, David P. et al., "MEMS-Based Acoustic Array Technology," 40th AIAA Aerospace Sciences Meeting & Exhibit, Jan. 14-17, 2000, American Institute of Aeronautics and Astronautics, Reston, Virginia.
Kress, H.J. et al, "Integrated Silicon Pressure Sensor for Automotive Application with Electronic Trimming," SAE International, International Congress and Exposition, Detroit, Michigan (Feb. 27, 1995-Mar. 2, 1995).
Wiley Electrical and Electronics Engineering Dictionary, p. 275, IEEE Press (2004).
Initial Determination on Violation of Section 337 and Recommended Determination on Remedy and Bond, In the Matter of Certain Silicon Microphone Packages and Products Containing the Same, ITC Inv. No. 337-TA-695 (Nov. 22, 2010).
Notice of Commission Determination to Review in Part an Initial Determination, In the Matter of Certain Silicon Microphone Packages and Products Containing the Same, ITC Inv. No. 337-TA-695 (Jan. 21, 2011).
Initial Determination on Violation of Section 337 and Recommended Determination on Remedy and Bond, In the Matter of Certain Silicon Microphone Packages and Products Containing the Same, ITC Inv. No. 337-TA-629 (Jan. 12, 2009).
Commission Opinion, In the Matter of Certain Silicon Microphone Packages and Products Containing the Same, ITC Inv. No. 337-TA-629 (Aug. 18, 2009).
Federal Circuit Court of Appeals Opinion, *Mems Technology Berhad* v *International Trade Commission and Knowles Electronics LLC*, Case No. 2010-1018 (Jun. 3, 2011).
Initial Determination Terminating Investigation Based on Settlement Agreement, In the Matter of Certain Silicon Microphone Packages and Products Containing the Same, ITC Inv. No. 337-TA-825 (Mar. 12, 2013).
Joint Stipulation of Dismissal, *Knowles Electronics, LLC* v. *Analog Devices, Inc*., United States District Court for the Northern District of Illinois, Civil Action No. 1:11-cv-06804 (Mar. 12, 2013).
Notification of Docket Entry, *Knowles Electronics, LLC* v. *Analog Devices, Inc*., United States District Court for the Northern District of Illinois, Civil Action No. 1:11-cv-06804 (Mar. 13, 2013).
Notice of a Commission Determination Not to Review an Initial Determination Terminating Investigation Based on a Settlement Agreement; Termination of the Investigation, In the Matter of Certain Silicon Microphone Packages and Products Containing the Same, ITC Inv. No. 337-TA-825 (Apr. 8, 2013).
Corrected Conditional Rebuttal Expert Report of Wilmer Bottoms Regarding Validity, Public Version, In the Matter of Certain Silicon Microphone Packages and Products Containing the Same, ITC Inv. No. 337-TA-825 (Mar. 7, 2013).
Initial Post-Hearing Brief of Complainant Knowles Electronics, LLC, Public Version, In the Matter of Certain Silicon Microphone Packages and Products Containing the Same, ITC Inv. No. 337-TA-825 (Mar. 7, 2013).
Reply Post-Hearing Brief of Complainant Knowles Electronics, LLC, Public Version, In the Matter of Certain Silicon Microphone Packages and Products Containing the Same, ITC Inv. No. 337-TA-825 (Mar. 7, 2013).
Expert Report of Prof. Michael G. Pecht, Public Version, In the Matter of Certain Silicon Microphone Packages and Products Containing the Same, ITC Inv. No. 337-TA-825 (Mar. 7, 2013).
Initial Post-Hearing Brief of Respondents Analog Devices, Inc., Amkor Technology, Inc. & Avnet, Inc., Public Version, In the Matter of Certain Silicon Microphone Packages and Products Containing the Same, ITC Inv. No. 337-TA-825 (Mar. 7, 2013).
Reply Post-Hearing Brief of Respondents Analog Devices, Inc., Amkor Technology, Inc. & Avnet, Inc., Public Version, In the Matter of Certain Silicon Microphone Packages and Products Containing the Same, ITC Inv. No. 337-TA-825 (Mar. 7, 2013).
Opinion and Order, Motion for Reconsideration of the Court's Claim Construction Ruling, *Knowles Electronics, LLC* v. *Analog Devices, Inc*., United States District Court for the Northern District of Illinois, Civil Action No. 1:11-cv-06804 (Feb. 19, 2013).
Rulings on Claim Construction, *Knowles Electronics, LLC* v. *Analog Devices, Inc*., United States District Court for the Northern District of Illinois, Civil Action No. 1:11-cv-06804 (May 30, 2012).
Opinion and Order, Motion for Partial Summary Judgment, *Knowles Electronics, LlC* v. *Analog Devices, Inc*., United States District Court for the Northern District of Illinois, Civil Action No. 1:11-cv-06804 (Mar. 7, 2013).
A. Dehe et al., *Silicon Micromachined Microphone Chip at Siemens*, 137th Regular Meeting of the Acoustical Society of America, Mar. 16, 1999, US.
A. J. Sprenkels, J.A. Voorthuryzen, and P. Bergveld, "A theoretical analysis of the electric airgap field-effect structure for sensors applications," 1986, US.
A.J. Sprenkels, W. Olthius, and P. Bergveld, "The application of silicon dioxide as an elecret materials", Proc. 6th Int. Symp. Electrets, ISE 6, p. 164-169, 1988, UK.
E.H. Pederson et al., "Flip-Chip Hermetic Packaging for MEMS", Proceedings of Eurosensors XIV, Copenhagen, Denmark, Aug. 27-30, 2000 US.
J.A. Voorthuyzen and P. Bergveld, "Semiconductor-based electret sensor for sound and pressure", IEEE Trans. Dielect, Elect. Insulation, 1989, p. 267-276.
J.A. Voorthuyzen and P. Bergveld, "The PRESSFET: An integrated electret-MOSFET based pressure sensor", Sens Actuators, 1988, p. 349-360.
Joint Electron Device Engineering Council, "JEDEC Standard, Descriptive Designation System for Semiconductor-Device Packages, JESD3O-B, Elec. Indus. Ass'n" Apr. 1995, US.
Kourosh Amiri Jam et al., "Design Methodology of Modular Microsystems", Mar. 29, 2001, Germany.
M. Schuenemann et al., "A highly flexible design and production framework for modularized microelectromechanical systems", Oct. 7, 1998, pp. 153-168.
Malshe et al., "Challenges in the Packaging of MEMS", 1999, p. 41-47, US.
Pecht et al., *Plastic-Encapsulated Microelectronics*, 1995, p. 460, US.
Prasad, Ray P., "Surface Mount Technology: Principles and Practices" 2nd Edition, 1997, p. 3-50, 129-135, 149-203, 339-597, 747-757, US.
Tummala, Rao R., "Microelectronics Packaging Handbook: Semiconductor Packaging Part II", 1997, pp. 1-42; Ch. 7 p. 11-3 to 11-128; Ch. 8.3 p. 11-136 to 11-185; Ch. 9 p. 11-284 to 11-393; Section 11.5 p. 11-516 to 11-527; Section 11.6 p. 11-528 to 11-533; Ch. 14 p. 11-873 to 11-927; Glossary pp. 11-931 to 11-976, USA.

(56) References Cited

OTHER PUBLICATIONS

Tummala, Rao R., "Fundamentals of Microsystems Packaging", 2001, p. 2-42, 65-68, 81-119, 120-183, 265-294, 297-340, 543-578, 580-610, 659-693, 695-747, 678-682, 924-944, US.
Respondents' Notice of Prior Art, In the Matter of Certain Silicon Microphone Packages and Products Containing the Same, ITC Inv. No. 337-TA-888 (Oct. 23, 2013).
Construing Terms of Asserted Claims of Patents at Issue & Denying Complainants' Motion to Supplement Its Proposed Claim Constructions, Inv. No. 337-TA-888, U.S. Int'l Trade Commission, Apr. 15, 2014.
Respondents Goertek, Inc.'s, and Goertek Electronics, Inc.'s Petition for Review of Initial and Recommended Determinations, Inv. No. 337-TA-888, U.S. Int'l Trade Commission, Sep. 17, 2014.
Respondents Goertek, Inc.'s, and Goertek Electronics, Inc.'s Response to Complainant Knowles Electronics LLC's Contingent Petition for Review of Final Initial Determination, Inv. No. 337-TA-888, U.S. Int'l Trade Commission, Sep. 29, 2014.
Complainant Knowles Electronics, LLC's Contingent Petition for Review of Final Initial Determination, Inv. No. 337-TA-888, U.S. Int'l Trade Commission, Sep. 17, 2014.
Complainant Knowles Electronics, LLC's Response to Petition for Review of Respondents Goertek Inc. and Goertek Electronics, Inc., Inv. No. 337-TA-888, U.S. Int'l Trade Commission, Sep. 29, 2014.
Complainant Knowles Electronics, LLC's Statement on the Public Interest Pursuant to 19 C.F.R. § 210.50(a)(4), Inv. No. 337-TA-888, U.S. Int'l Trade Commission, Oct. 2, 2014.
Summary of Complainant Knowles Electronics, LLC's Response to Petition for Review of Respondents Goertek Inc. and Goertek Electronics, Inc., Inv. No. 337-TA-888, U.S. Int'l Trade Commission, Sep. 29, 2014.
Notice Regarding Issuance of Public Version of Final Initial Determination and Recommended Determination on Remedy and Bond, Inv. No. 337-TA-888, U.S. Int'l Trade Commission, Oct. 15, 2014.

MICROPHONE ASSEMBLY WITH BARRIER TO PREVENT CONTAMINANT INFILTRATION

CROSS REFERENCE TO RELATED APPLICATION

This patent claims benefit under 35 U.S.C. §119 (e) to U.S. Provisional Application No. 61/681,685 entitled "Microphone Assembly with Barrier to Prevent Contaminant Infiltration" filed Aug. 10, 2012, the content of which is incorporated herein by reference in its entirety.

TECHNICAL FIELD

This application relates to acoustic devices and, more specifically, to barriers that prevent intrusion of contaminants within these devices.

BACKGROUND OF THE INVENTION

MicroElectroMechanical System (MEMS) assemblies include microphones and speakers to mention two examples. These MEMS devices may be used in diverse applications such as within hearing aids and cellular phones.

In the case of a MEMS microphone, acoustic energy typically enters through a sound port in the assembly, vibrates a diaphragm and this action creates a corresponding change in electrical potential (voltage) between the diaphragm and a back plate disposed near the diaphragm. This voltage represents the acoustic energy that has been received. Typically, the voltage signal is then transmitted to an electric circuit (e.g., an integrated circuit such as an application specific integrated circuit (ASIC)). Further processing of the signal may be performed on the electrical circuit. For instance, amplification or filtering functions may be performed on the voltage signal by the integrated circuit.

As mentioned, sound typically enters the assembly through an opening or port. When a port is used, this opening also allows other unwanted or undesirable items to enter the port. For example, various types of contaminants (e.g., solder, flux, dust, and spit, to mention a few possible examples) may enter through the port. Once these items enter the assembly, they may damage the internal components of the assembly such as the MEMS device and the integrated circuit.

Previous systems have sometimes deployed particulate filters that prevent some types of debris from entering an assembly. Unfortunately, these filters tend to adversely impact the operation of the microphone. For instance, the performance of the microphone sometimes becomes significantly degraded when using these previous approaches. Microphone customers often elect to not use such microphones in their applications because of the degraded performance.

BRIEF DESCRIPTION OF THE DRAWINGS

For a more complete understanding of the disclosure, reference should be made to the following detailed description and accompanying drawings wherein.

Figure 1:
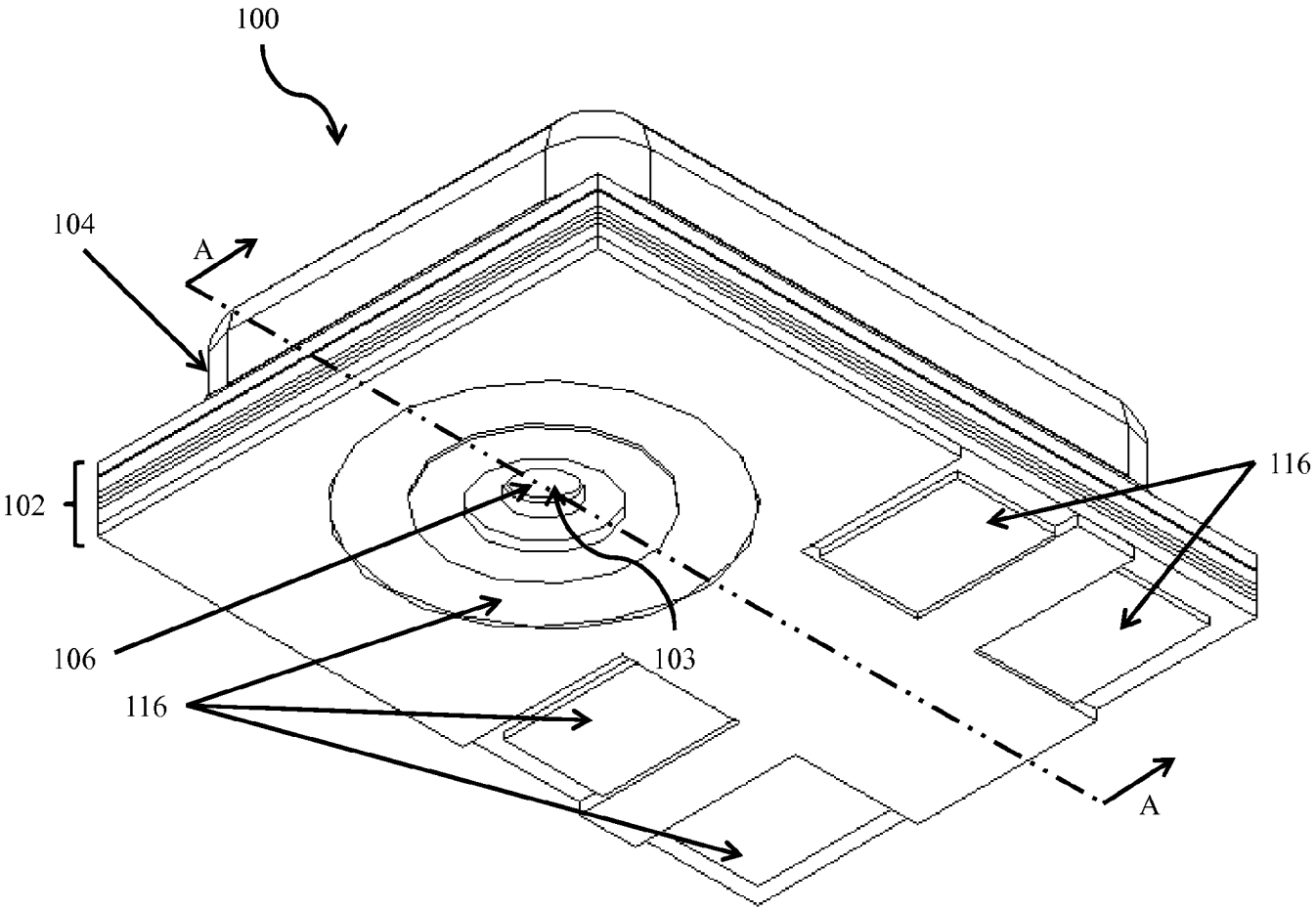
FIG. 1 is a perspective diagram of a MEMS assembly according to various embodiments of the present invention.

Skilled artisans will appreciate that elements in the figures are illustrated for simplicity and clarity. It will further be appreciated that certain actions and/or steps may be described or depicted in a particular order of occurrence while those skilled in the art will understand that such specificity with respect to sequence is not necessarily required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

Acoustic assemblies (e.g., microphone assemblies) are provided wherein environmental barriers are deployed to reduce or eliminate the infiltration of environmental contaminants into the interior of these assemblies. In this respect, the structures provided herein significantly reduce or eliminate the intrusion of harmful environmental contaminants (e.g., fluids and particulates) from the exterior of the assembly to the interior of the assembly, can be easily and economically manufactured, and do not significantly degrade microphone performance in terms of sensitivity (and in some cases improve some aspects of the performance of the microphone, for example, flat sensitivity response in the audio band).

In some of these embodiments, a microphone assembly includes a base and a cover that is connected to the base. An interior cavity is formed between the cover and the base in which is disposed a MEMS apparatus. Either the base or the cover has a port extending therethrough. A barrier is embedded in the base or the cover so as to extend across the port. The barrier prevents at least some contaminants from entering the interior of the assembly and damaging the components disposed therein such as the MEMS apparatus. In some aspects, the embedded barrier is a porous membrane, filter or mesh and in other aspects the barrier is a patterned flex circuit with openings disposed therethrough.

In still others of these embodiments, a microphone assembly includes a base and a cover. An interior cavity is formed between the cover and the base in which is disposed a MEMS apparatus. A second cavity is formed within the base. A first opening or hole in the base allows external sound to enter the second cavity from the exterior of the assembly and a second opening or hole in the base allows the sound to move from the second cavity to the MEMS apparatus that is disposed in the interior cavity of the assembly. The openings and the second cavity in the base form a baffle structure that is effective in preventing at least some contaminants from entering the interior of the assembly using an indirect path.

In yet others of these embodiments, a microphone assembly includes a base and a cover. An interior cavity is formed between the cover and the base in which is disposed a MEMS apparatus. A port extends through the base and the MEMS apparatus is disposed in the interior of the assembly and over the port. A barrier is also disposed over the port. In some aspects, the barrier includes a tunnel that forms a tortuous (e.g., twisting) path for sound entering the port to traverse before the sound is received at the MEMS apparatus. In other aspects, the barrier is constructed of a porous material and sound proceeds through the barrier to be received at the MEMS apparatus. However, the tortuous path is effective in preventing at least some contaminants from entering the interior of the assembly.

In yet others of these embodiments, a microphone assembly includes a base and a cover. An interior cavity is formed between the cover and the base in which is disposed a MEMS apparatus. A MEMS apparatus is disposed in the interior of the assembly within the cavity. In the assembly, the port hole is not a completely open hole. Instead, sound enters through portions of the lid. In one aspect, the lid includes a partially fused area through which sound enters the interior of the assembly and a highly fused area where sound does not enter the assembly. The non-fused portion of the lid is effective for preventing at least some contaminants from entering the interior of the assembly.

In still others of these embodiments, a microphone assembly includes a base and a cover. An interior cavity is formed between the cover and the base in which is disposed a MEMS apparatus. A MEMS apparatus is disposed in the interior of the assembly within the cavity and a port is formed in the assembly. The lid is formed with a metal mesh surrounded by an optional outer material thereby making the entire metal mesh lid the acoustic port. In cases, were an outer material is used, portions of the cover can be removed to create a port that exposes the metal mesh. Consequently, sound is allowed to enter the port, traverse through the mesh, and be received at the MEMS apparatus. At the same time, the metal mesh is effective to prevent at least some contaminants from entering the interior of the assembly while maintaining a significant degree of electromagnetic immunity.

In yet others of these embodiments, a microphone assembly includes a base and a cover. A port extends through the base and a MEMS apparatus is disposed at the base in the interior of the assembly and over the port. A membrane or passivation layer is attached to and extends across the base and over the port. The membrane or passivation layer includes openings through which expose metal solder pads on the base, effectively preventing solder bridging between the pads during reflow. The membrane that extends across the base (and port) is effective for preventing at least some contaminants from entering the interior of the assembly but at the same time allows sound to pass therethrough.

As used herein, "contaminants" refers to any type or form of undesirable material that could enter an assembly from the environment external to the assembly. For example, contaminants may include dust, dirt, water, vapor, to mention only a few examples.

Figure 2:
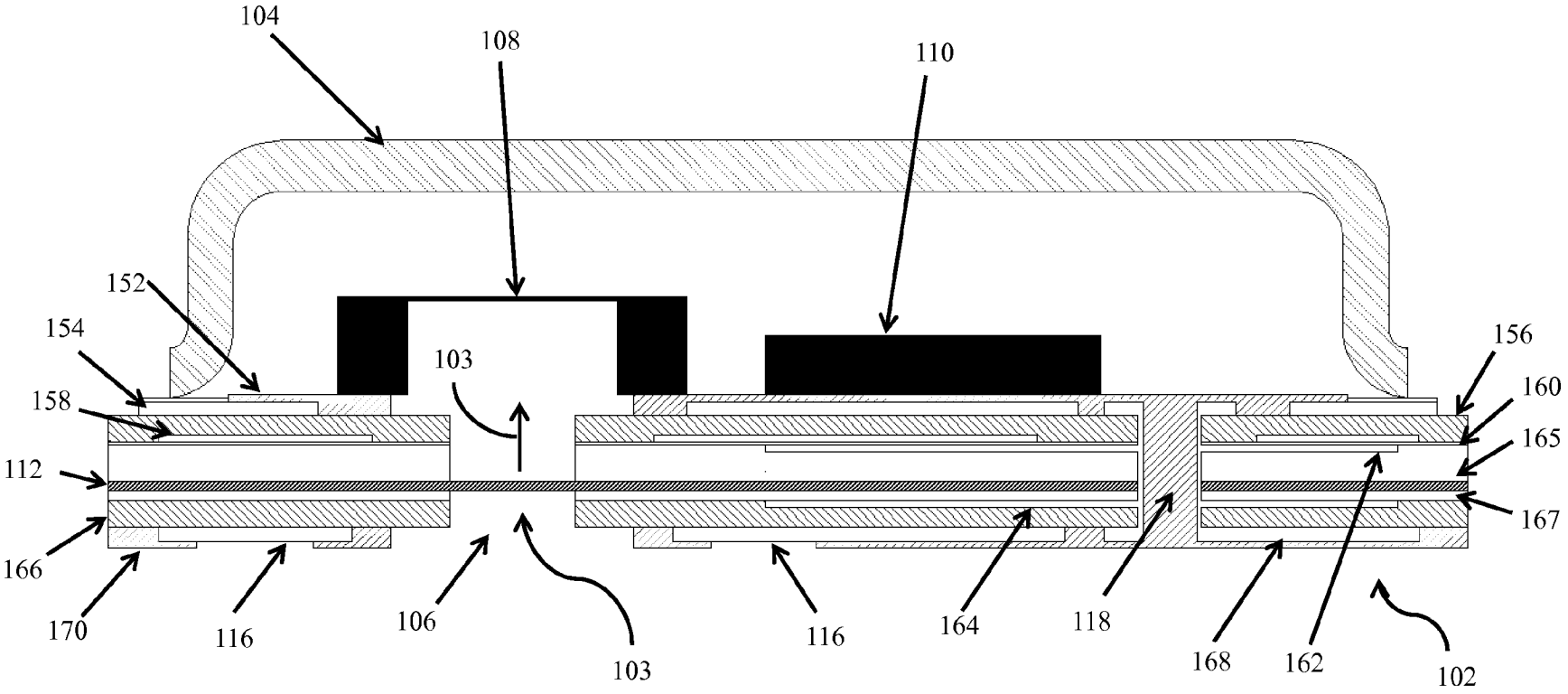
FIG. 2 is a cross-sectional view of the MEMS assembly of FIG. 1 taken along lines A-A according to various embodiments of the present invention.

Referring now to FIGS. 1-2, one example of an embedded barrier deployed in a microphone assembly 100 is described. The assembly 100 includes a base 102, a lid 104, a port 106, a Microelectromechanical System (MEMS) apparatus 108, and an integrated circuit 110. A barrier 112 is embedded in the base 102. Although shown as being embedded in the base 102 (making the assembly 100 a bottom port device), it will be appreciated that the port 106 can be moved to the lid 104 (thereby making the device a top port device) and the barrier 112 can be embedded in the lid 104.

Generally speaking and as described elsewhere herein, each of the lid 104 and base 102 are formed of one or more layers of materials. For example, these components may be constructed of one or more FR-4 boards, and may have various conductive and insulating layers arranged around these boards.

The port 106 extends through the base 102 and the MEMS apparatus 108 is disposed over the port. Conductive traces (not shown) couple the output of the integrated circuit 110 to conductive pads 116 on the base. A customer can make an electrical connection with the pads 116 for further processing of the signal that is received from the integrated circuit 110. Multiple vias, such as via 118, extend through the base 102 and allow electrical connections to be made between the integrated circuit 110 and the conductive pads 116.

The MEMS apparatus 108 receives acoustic energy which is transduced into electrical energy. In that respect, the MEMS apparatus 108 may include a diaphragm and a back plate. Acoustic energy causes movement of the diaphragm and this varies the voltage between the diaphragm and the back plate. The electrical signal that is produced represents the acoustic energy that has been received by the MEMS apparatus 108. The MEMS apparatus 108 is attached to the base by adhesive or any other appropriate fastening mechanism or approach.

The integrated circuit 110 is any kind of integrated circuit that performs any kind of processing function. In one example, the integrated circuit 110 is a buffer or an amplifier. Other examples of integrated circuits are possible. Although only one integrated circuit is shown in this example, it will be appreciated that multiple integrated circuits may also be deployed. And, as used herein, "integrated circuit (IC)" refers to any type of processing circuitry performing any type of processing function.

In the example assembly of FIGS. 1-2, the barrier or membrane 112 is porous mesh (e.g., a single or multiple layers of fabric, metal mesh, or membrane to mention a few examples) or porous filter material. For example, the barrier 112 may be a membrane or woven fabric to mention two examples. The barrier 112 is porous allowing sound to enter but is configured to prevent at least some contaminants from passing therethrough. In other aspects and as described elsewhere herein it can also be a patterned flex printed circuit board (PCB). In either case, the barrier 112 is embedded in the base 102. By "embedded" and as used herein, it is meant that the barrier 112 is not placed or attached to a top or bottom surface of the base 102, but instead is at least partially disposed or embedded within the base 102 and across the port 106. In this respect and as described elsewhere herein, the base 102 may include two or more printed circuit boards (PCBs) and the barrier 112 may be sandwiched or disposed.

Referring now especially to FIG. 2, an expanded cross-sectional view of the base 102 (with the embedded barrier 112) is described. The barrier 112 extends completely across the base 102. However, it will be appreciated that in some aspects the barrier 112 may be disposed in a cavity and not extend completely across the base 102. More specifically, a cavity may be created in the interior of the base 102 about or around the port 106 and the barrier 112 may be inserted into this cavity.

The base 102 in this example includes a first solder mask 152, a first metal layer 154, a first core layer 156, a second metal layer 158, a dielectric layer 160, a third metal layer 162, an adhesive layer 165, the barrier 112, another adhesive layer 167, a fourth metal layer 164, a second core layer 166, a fifth metal layer 168, and a second solder mask 170. The metal layers provide conductive paths for signals and may be constructed of copper clad in one example. The core layers may be FR-4 boards in one example. The port 106 extends through the base 102 but the barrier 112 extends across the port, permitting sound (indicated by air path 103) to enter the interior of the assembly but preventing contaminants from entering the assembly 100. The function of the dielectric layer 160 is to provide additional capacitance for improved electromagnetic immunity. It will be appreciated that the above-mentioned structure is only one possible structure and that other structures and configurations are possible. For instance, the dielectric layer (and the metal layers on either side of it) may be eliminated or additional PCB layers added.

Figure 3:
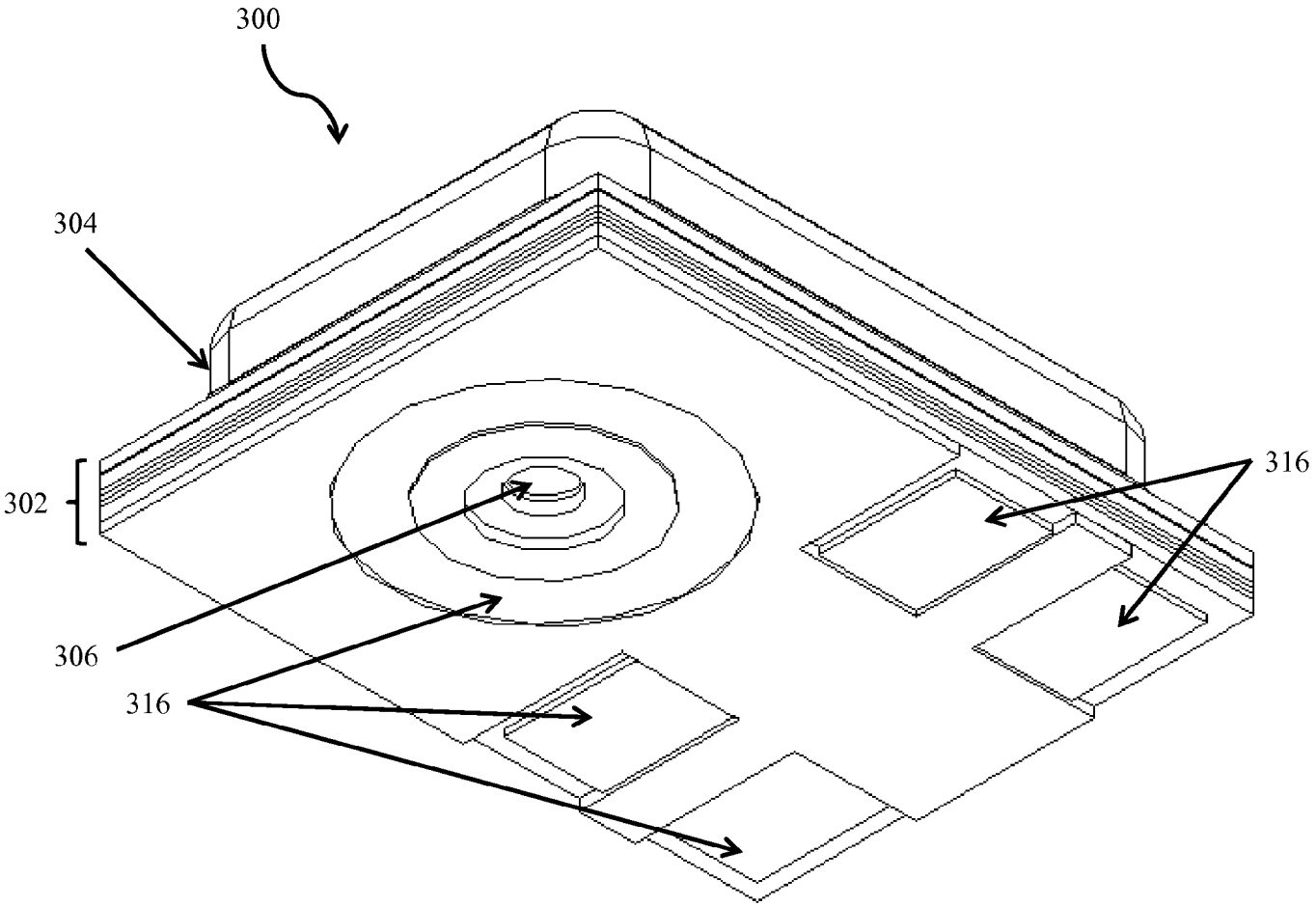
FIG. 3 comprises a perspective view of a MEMS assembly according to various embodiments of the present invention.
Figure 4:
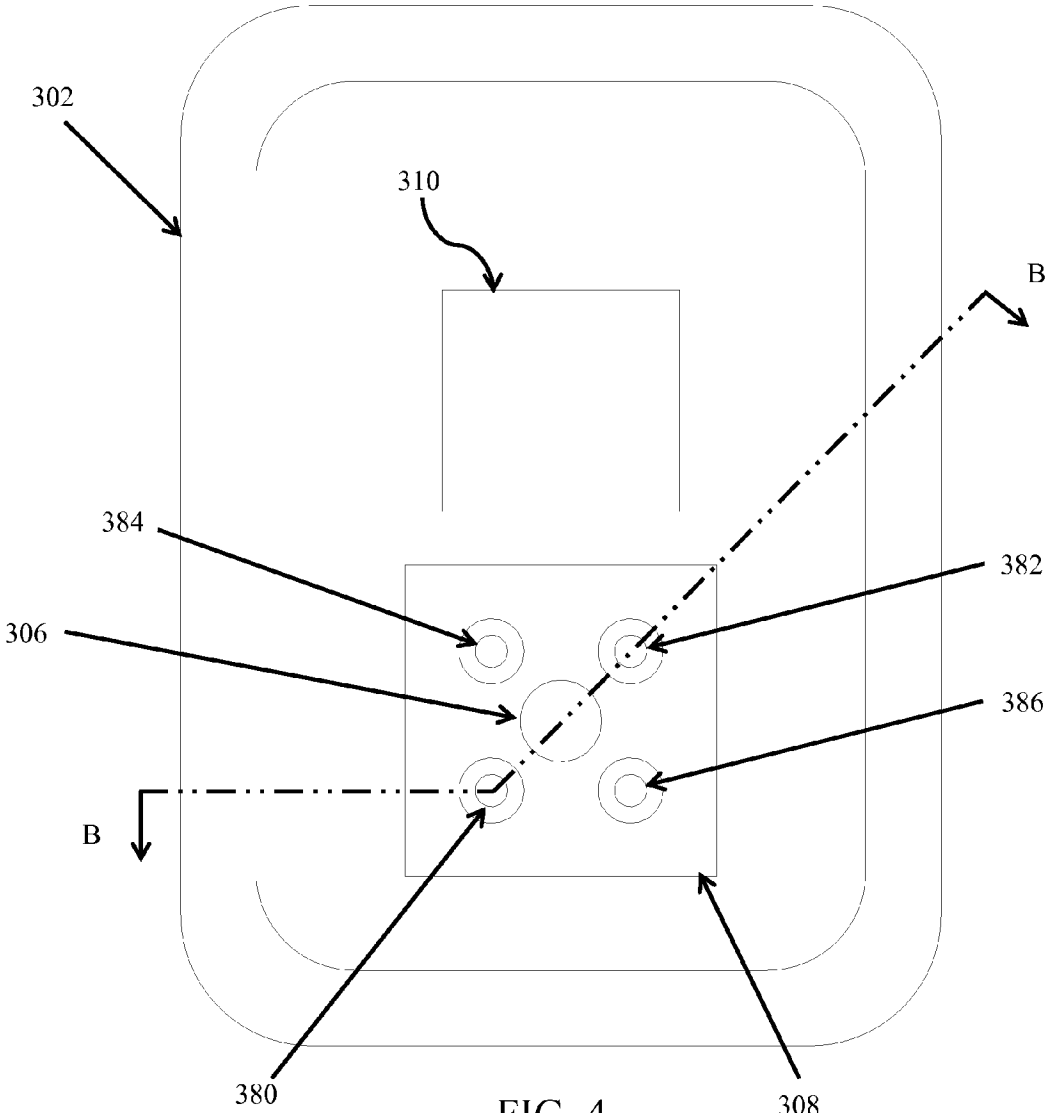
FIG. 4 comprises a top view of the inside of the assembly of FIG. 3 according to various embodiments of the present invention.
Figure 5:
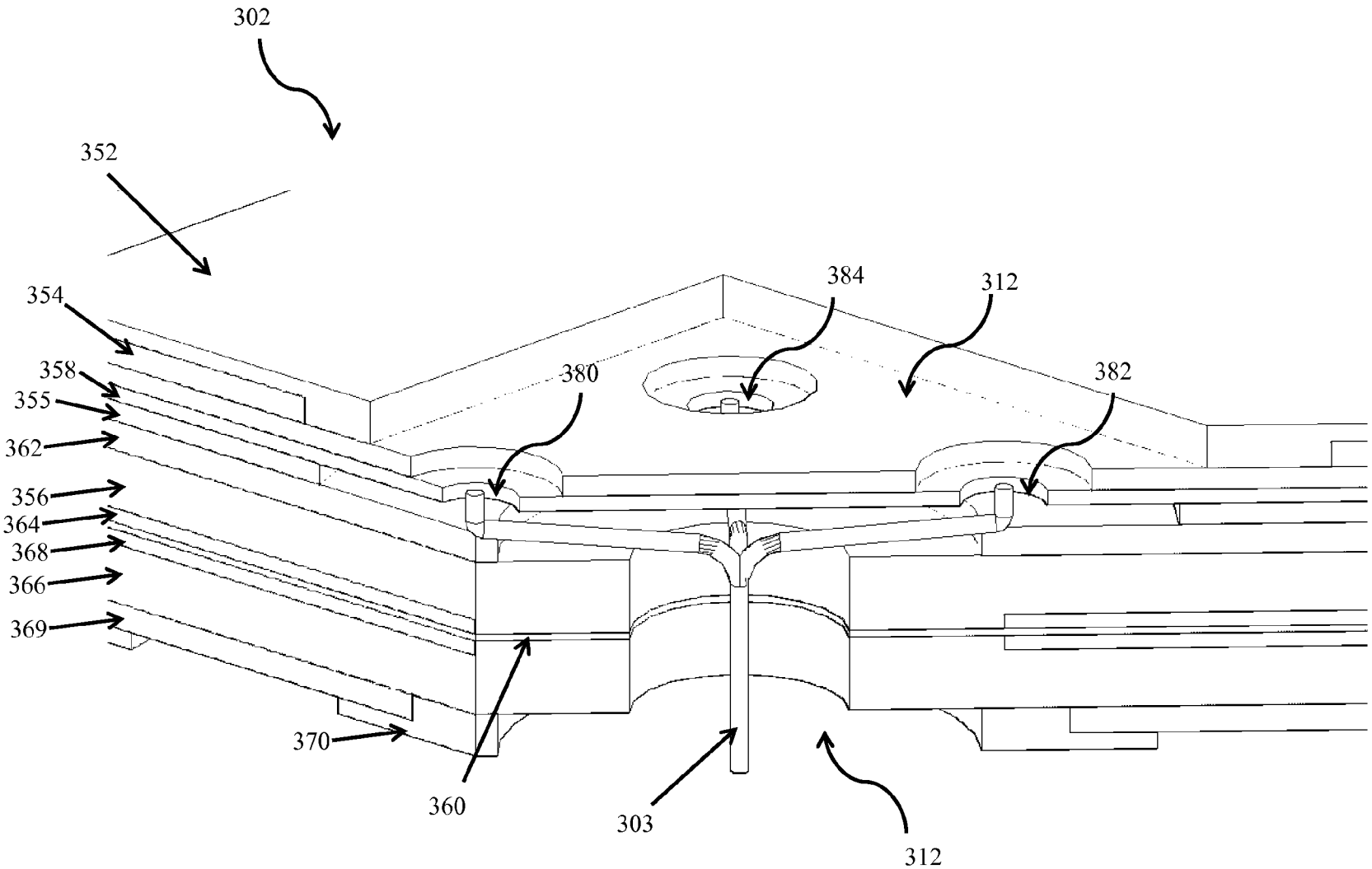
FIG. 5 comprises a cross-sectional view taken along line B-B of the barrier of FIGS. 3 and 4 according to various embodiments of the present invention.

Referring now to FIGS. 3-5, another example of an assembly with an embedded barrier 312 is described. In this example, the barrier 312 is a patterned rigid-flex PCB. By "flex," it is meant that flexible or compliant, such as polyimide film.

The assembly 300 includes a base 302, a lid 304, a port 306, a Microelectromechanical System (MEMS) apparatus 308, and an integrated circuit 310. The barrier 312 is embedded in the base 302, or on one side of the base (top or bottom). Although shown as being on top of the base 302 (making the assembly 300 a bottom port device), it will be appreciated that the port 306 can be moved to the lid 304 (thereby making the device a top port device) and the barrier 312 can be embedded in the lid 304.

Generally speaking and as described elsewhere herein, each of the lid 304 and base 302 are formed of one or more layers of materials. For example, these components may be constructed of FR-4 boards and printed circuit boards, and may have various conductive and insulating layers arranged around these boards.

The port 306 extends through the base 302 and the MEMS apparatus 308 extends over the port. Conductive traces (not shown) couple the output of the integrated circuit 310 to conductive pads 316 on the base. A customer can make an electrical connection with the pads 316 for further processing of the signal that is received from the integrated circuit 310.

The MEMS apparatus 308 receives acoustic energy which is transduced into electrical energy. In that respect, the MEMS apparatus 308 may include a diaphragm and a back plate. Acoustic energy causes movement of the diaphragm and this varies the charge between the diaphragm and the back plate. The resulting electrical signal that is produced represents the acoustic energy that has been received by the MEMS apparatus 308. The MEMS apparatus 308 is attached to the base by adhesive or any other appropriate fastening mechanism or approach.

The integrated circuit 310 is any kind of integrated circuit that performs any kind of processing function. In one example, the integrated circuit 310 is a buffer or an amplifier. Other examples of integrated circuits are possible. Although only one integrated circuit is shown in this example, it will be appreciated that multiple integrated circuits may be deployed.

And as mentioned, as used herein "integrated circuit (IC)" refers to any type of processing circuitry performing any type of processing function.

In the example of FIGS. 3-5, the barrier 312 is a patterned flex printed circuit board (FPCB). By "patterned," it is meant that material is removed, for example, by photo lithography and etching or laser ablation to form either multiple circular openings or geometric shapes that allow for air to pass through in such a manner that it generates an indirect or tortuous path. Referring now especially to FIG. 5, an expanded view of the base (with the embedded barrier 312) is described. The barrier 312 extends completely across the base 302. However, it will be appreciated that in some aspects the barrier 312 may be disposed in a cavity and not extend completely across the base 302.

The base 302 includes a first solder mask 352, a first metal layer 354, the barrier 312 (a flex layer), a second metal layer 358, adhesive 355, a third metal layer 362, a first core layer 356, a fourth metal layer 364, a dielectric layer 360, a fifth metal layer 368, a second core layer 366, a sixth metal layer 369, and a second solder mask 370. The metal layers provide conductive paths for signals. The core layers may be FR-4 boards in one example. The port 306 extends through the base 302. The barrier 312 extends across the port 306 with circular openings 380, 382, 384, and 386 permitting sound (indicated by air path 303) to enter the interior of the assembly 300 but preventing at least some contaminants from entering the assembly 300. It will be appreciated that the above-mentioned structure is only one possible structure and that other structures are possible.

It will be appreciated that the shape, number, placement or other characteristics of the openings 380, 382, 384, and 386 in the barrier 312 may be adjusted to filter certain types or sizes of contaminants. More specifically, specific sizes and/or shapes for the openings may be advantageous from preventing certain-sized particulates from entering the interior of the assembly 300. The placement of the openings relative to each other may also serve to filter some types and/or sizes of contaminants. It should also be noted that the surface of barrier 312 may be treated with a hydrophobic coating to inhibit the liquid water from entering the interior of assembly 300.

In another example, the flex material or flex board is completely removed from extending over the port. In this case, one of the metal layers of the base can be extended over the port and include one or more openings that filter the contaminants. It will be appreciated that any of the other layers may be utilized to perform this function or that combinations of multiple layers (each having openings) may also be used.

Figure 6:
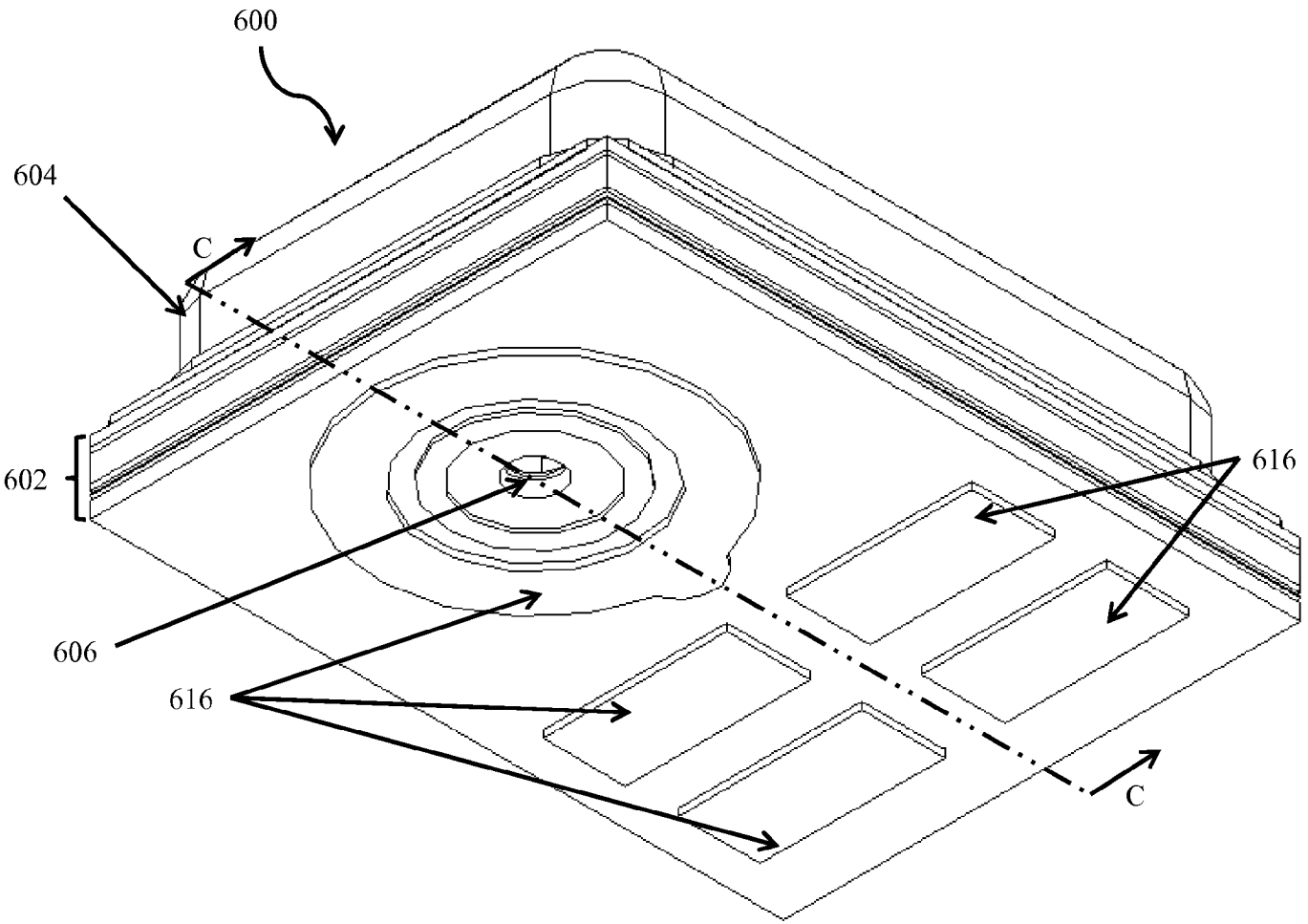
FIG. 6 comprises a perspective view of a MEMS assembly according to various embodiments of the present invention.
Figure 7:
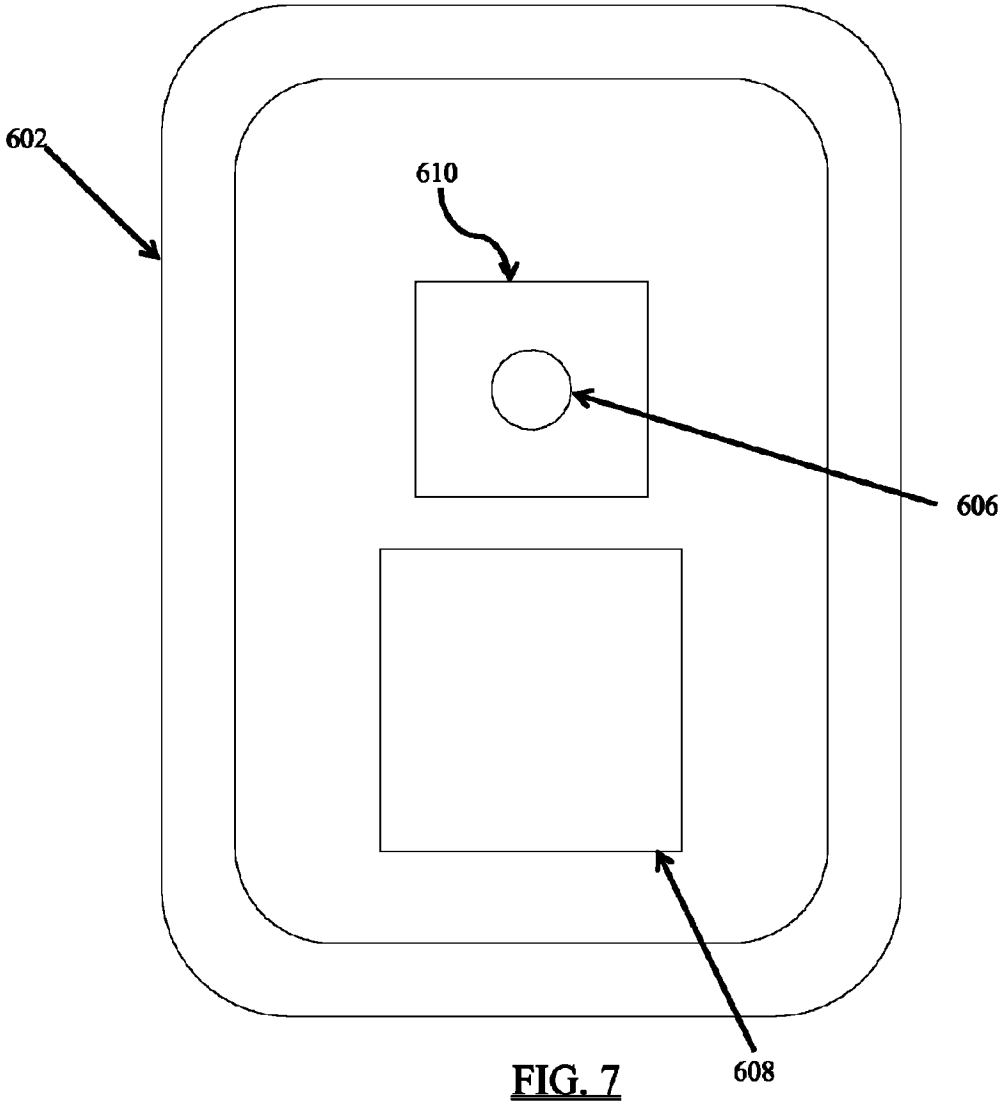
FIG. 7 comprises a top view of the base portion of the assembly of FIG. 6 according to various embodiments of the present invention.
Figure 8:
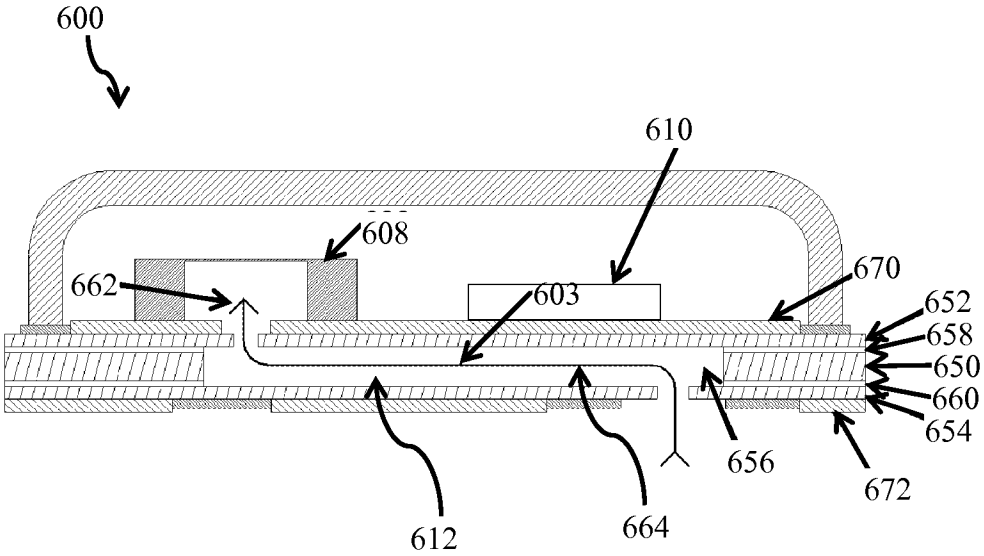
FIG. 8 comprises a cross-sectional view taken along line C-C of the barrier of FIGS. 6 and 7 according to various embodiments of the present invention.

Referring now to FIGS. 6-8, one example of a baffle structure that is disposed in the base of a MEMS assembly 600 and used as a particulate filter is described. The assembly 600 includes a base 602, a lid 604, a Microelectromechanical System (MEMS) apparatus 608, and an integrated circuit 610.

Each of the lid 604 and base 602 may be formed of one or more layers of materials. For example, these components may be constructed of FR-4 boards or printed circuit boards and may have various conductive and insulating layers arranged around these boards.

Conductive traces (not shown) couple the output of the integrated circuit 610 to conductive pads 616 on the base. A customer can make an electrical connection with the pads 616 for further processing of the signal that is received from the integrated circuit 610.

The MEMS apparatus 608 receives acoustic energy and which is transduced into electrical energy. In that respect, the MEMS apparatus 608 may include a diaphragm and a back plate. Acoustic energy causes movement of the diaphragm and this varies the voltage between the diaphragm and the back plate. The resulting electrical signal that is produced represents the acoustic energy that has been received by the MEMS apparatus 608. The MEMS apparatus 608 is attached to the base by adhesive or any other appropriate fastening mechanism or approach.

The integrated circuit 610 is any kind of integrated circuit that performs any kind of processing function. In one example, the integrated circuit 610 is a buffer or an amplifier. Other examples of integrated circuits are possible. Although only one integrated circuit is shown in this example, it will be appreciated that multiple integrated circuits may be deployed. And as mentioned, as used herein, "application specific integrated circuit (ASIC)" refers to any type of processing circuitry performing any type of processing function.

Referring now especially to FIG. 8, an expanded view of the base (with the baffle structure 612) is described. The base includes a first substrate (e.g., FR-4) 650, a first PCB 652, and a second PCB 654. An open cavity 656 is formed in the substrate 650. The two PCBs 652 and 654 are patterned for electrical trace routing. The PCBs 652 and 654 are also laminated with adhesive 658 and 660 to each side with adhesive to each side of the open cavity substrate 650. The adhesive 658 and 660 can be either a punched film adhesive or a printed adhesive. The adhesive flow is kept from filling the cavity 656 of the first substrate. Thru-hole vias (not shown) are drilled and plated to make the required electrical connections for operation of the assembly 600. Then, holes or openings 662 and 664 are drilled (e.g., using a laser or mechanical drill) through the first and second PCB boards 652 and 654. The holes or openings 662 and 664 are drilled from opposite sides of the finished laminated board and provide access to the cavity 656. In other words, the holes or openings 662 and 664 do not pass through all layers of the first and second PCB boards 652 and 654. Solder masks 670 and 672 are disposed on either side of the base 602. Together, the cavity 656 and holes or openings 662 and 664 form the baffle structure 612.

The hole or opening 662 communicates with the interior of the assembly 600 and is the sound inlet to the MEMS apparatus. The hole or opening 664 communicates with the exterior of the assembly 600 and is the acoustic port to a customer application. It will be appreciated that the holes or openings 662 and 664 are offset from each other and are in one aspect at opposite ends of the cavity 656. The placement of the holes or openings 662 and 664 in the cavity 656 provides a tortuous path for any contamination ingress into the open sound port of the microphone. After manufacturing of the substrate, the microphone assembly 600 is completed with the MEMS apparatus and integrated circuit attached, wire bonding, and lid attachment.

Figure 9:
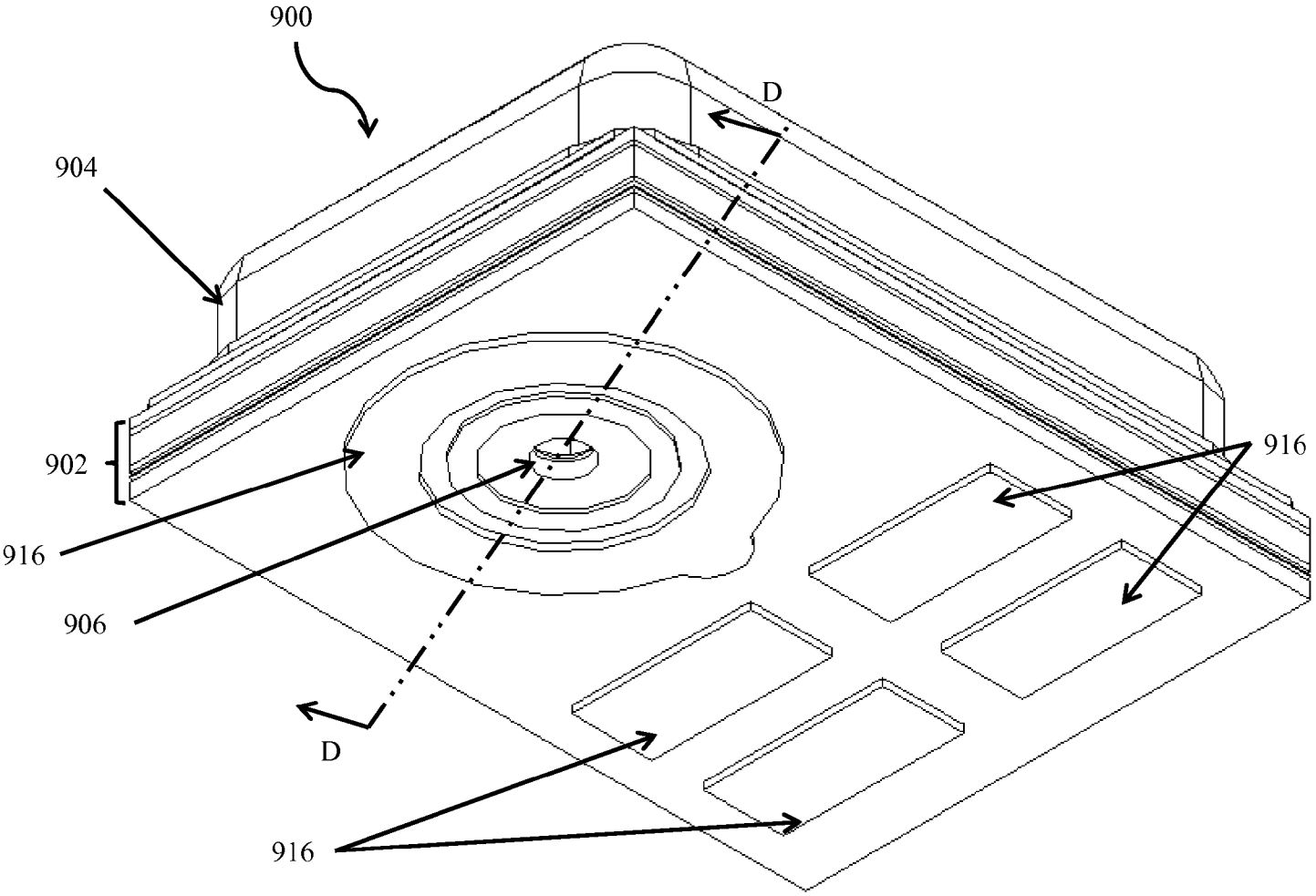
FIG. 9 comprises a perspective view of a MEMS assembly according to various embodiments of the present invention.
Figure 10:
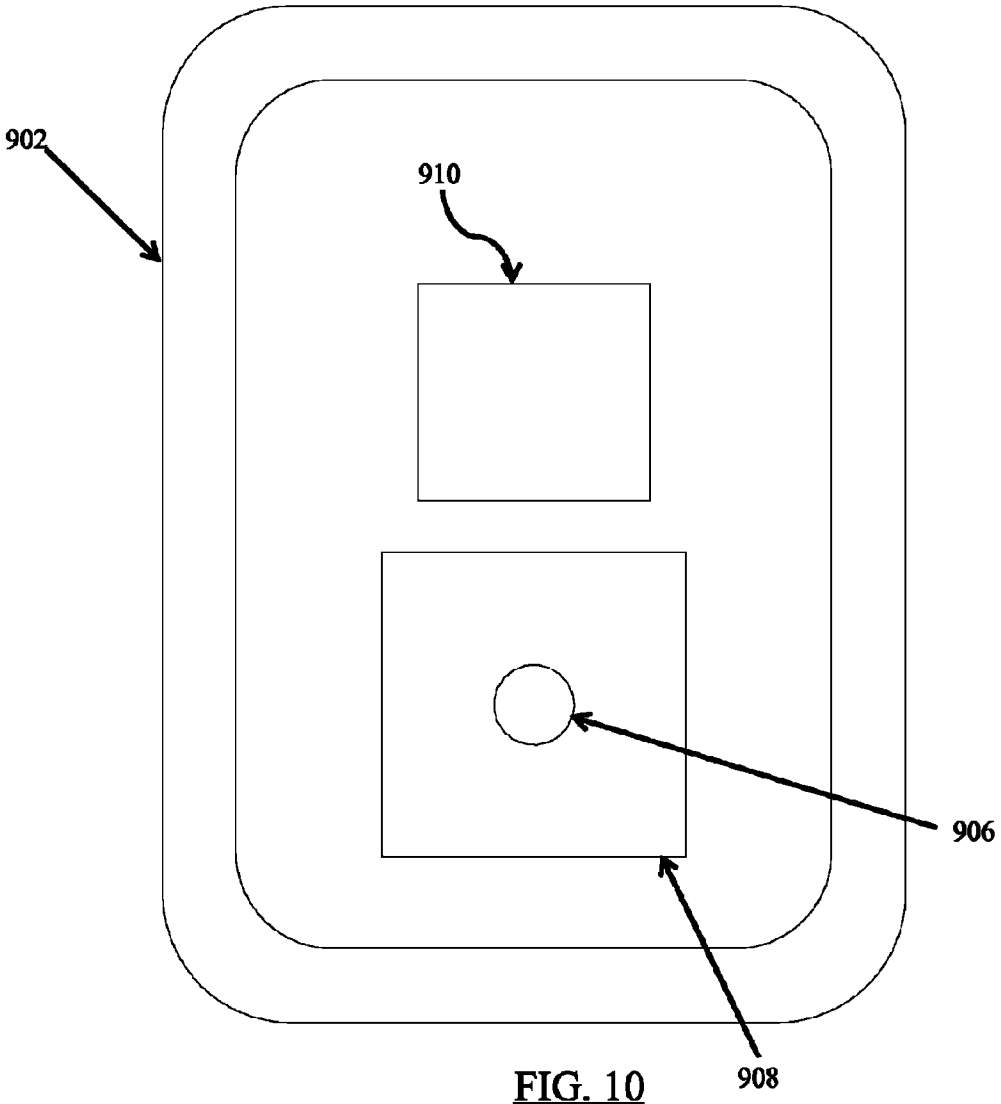
FIG. 10 comprises a top view of the base portion of the assembly of FIG. 9 according to various embodiments of the present invention.

It will be appreciated that sound (indicated by the arrow labeled 603) will traverse the baffle structure. However, at least some environmental contaminants may "stick" or otherwise remain in the baffle structure (e.g., in the cavity 656) and be prevented from entering the interior of the assembly 600, Referring now to FIGS. 9-11, another example of a baffle structure 912 disposed in the base of a MEMS assembly 900 that prevents at least some environmental contaminants from entering the interior of the assembly 900 is described. The assembly 900 includes a base 902, a lid 904, a Microelectromechanical System (MEMS) apparatus 908, and an integrated circuit 910.

Each of the lid 904 and base 902 may be formed of one or more layers of materials. For example, these components may be constructed of FR-4 boards and may have various conductive and insulating layers arranged around these boards.

Conductive traces (not shown) couple the output of the integrated circuit 910 to conductive pads 916 on the base. A customer can make an electrical connection with the conductive pads 916 for further processing of the signal that is received from the integrated circuit 910.

The MEMS apparatus 908 receives acoustic energy which is transduced into electrical energy. In that respect, the MEMS apparatus 908 may include a diaphragm and a back plate. Acoustic energy causes movement of the diaphragm and this varies the charge between the diaphragm and the back plate. The resulting electrical signal that is produced represents the acoustic energy that has been received by the MEMS apparatus 908. The MEMS apparatus 908 is attached to the base by adhesive or any other appropriate fastening mechanism or approach.

The integrated circuit 910 is any kind of integrated circuit that performs any kind of processing function. In one example, the integrated circuit 910 is a buffer or an amplifier. Other examples of integrated circuits are possible. Although only one integrated circuit is shown in this example, it will be appreciated that multiple integrated circuits may be deployed. And as mentioned, as used herein, "integrated circuit (IC)" refers to any type of processing circuitry performing any type of processing function.

Figure 11A:
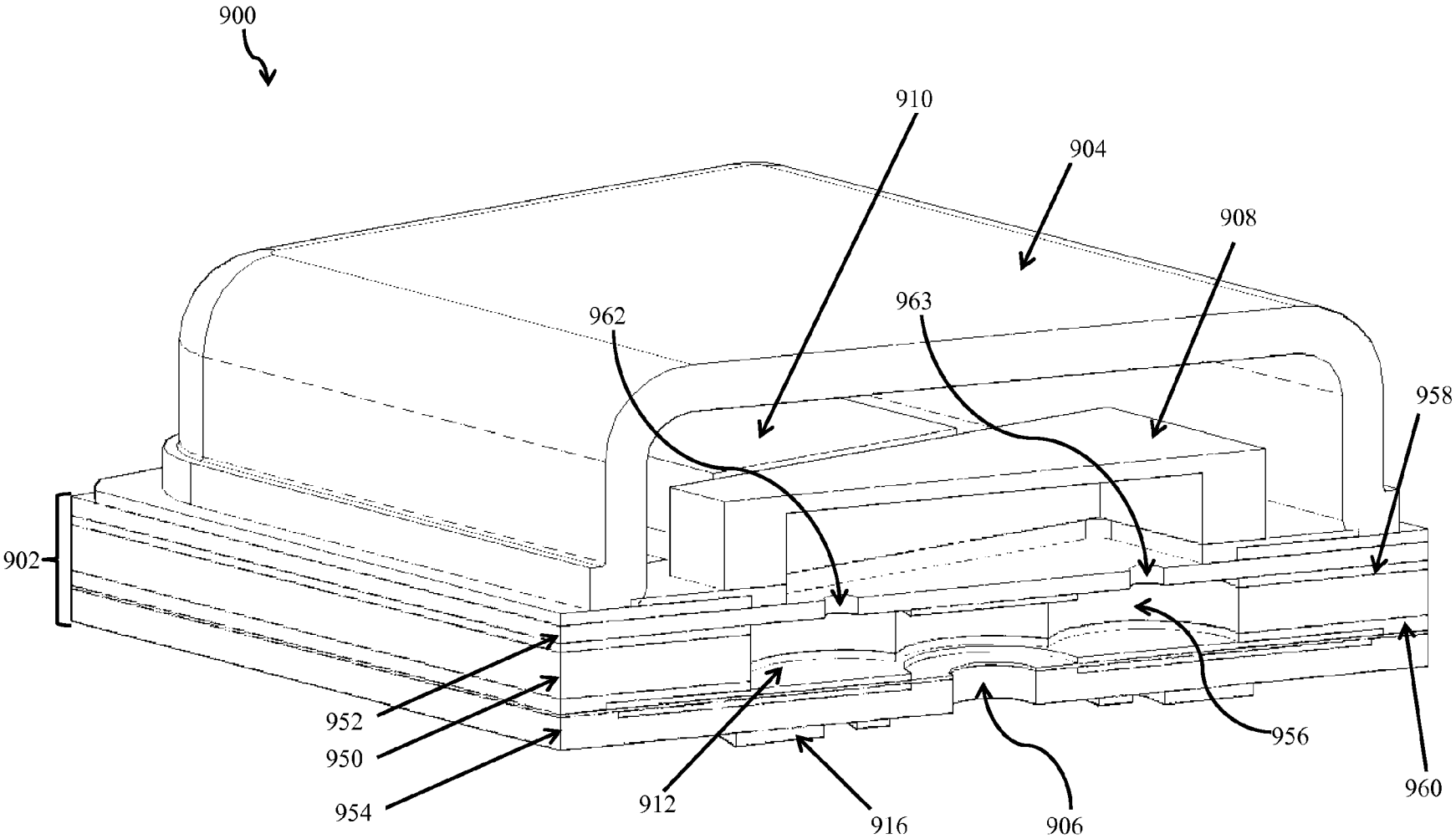
FIG. 11 A comprises a cross-sectional perspective view taken along line D-D of the barrier of FIGS. 9 and 10 according to various embodiments of the present invention.
FIG. 11B comprises a cross-sectional view of one example of a baffle according to various embodiments of the present invention.
FIG. 11C comprises a cross-sectional view of another example of a baffle according to various embodiments of the present invention.

Referring now especially to FIG. 11A, an expanded perspective cutaway view of the assembly (with the baffle structure 912) is described. The base includes a first substrate (e.g., FR-4) 950, a first PCB 952, and a second PCB 954. An open cavity 956 is formed in the substrate 950. The two PCBs 952 and 954 are patterned for electrical trace routing. These two PCBs 952 and 954 are laminated with adhesive 958 and 960 to each side with adhesive to each side of the first substrate 950 containing the open cavity or baffle 956. The adhesive 958 and 960 can be, for example, either a punched film adhesive or a printed adhesive. The adhesive flow is kept from filling the cavity of the first substrate. Thru hole vias (not shown) are drilled and plated to make the required electrical connections for operation of the assembly 900. Then, holes or openings 962, 963 and 906 are drilled through the first and second PCB boards. The holes or openings 962, 963 and 906 may be drilled using lasers or mechanical drilling approaches and are in one aspect drilled from opposite sides of the finished laminated board and provide access to the cavity 956. In other words, the holes or openings 962, 963, and 906 do not pass through all layers of the first and second PCB boards 952 and 954. Together, the holes or openings 962, 963, port 906, and cavity 956 form the baffle structure 912.

The holes or openings 962 and 963 are the sound inlets to the MEMS apparatus and the port hole 906 (disposed in the middle of the cavity 956) is the acoustic port to a customer application. The placement of the holes in the cavity provides a tortuous path for any contamination ingress into the open sound port of the microphone. After manufacturing of the substrate, the microphone assembly 900 is completed with the MEMS apparatus 908 and integrated circuit 910 attached, wire bonding, and lid attachment.

Figure 11B:
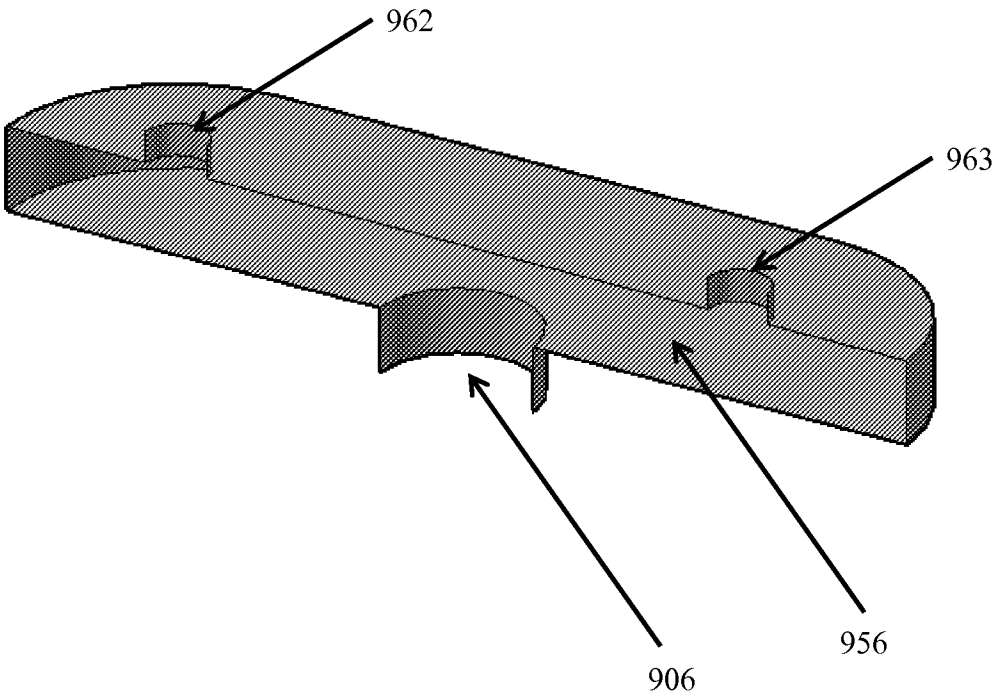
Figure 11C:
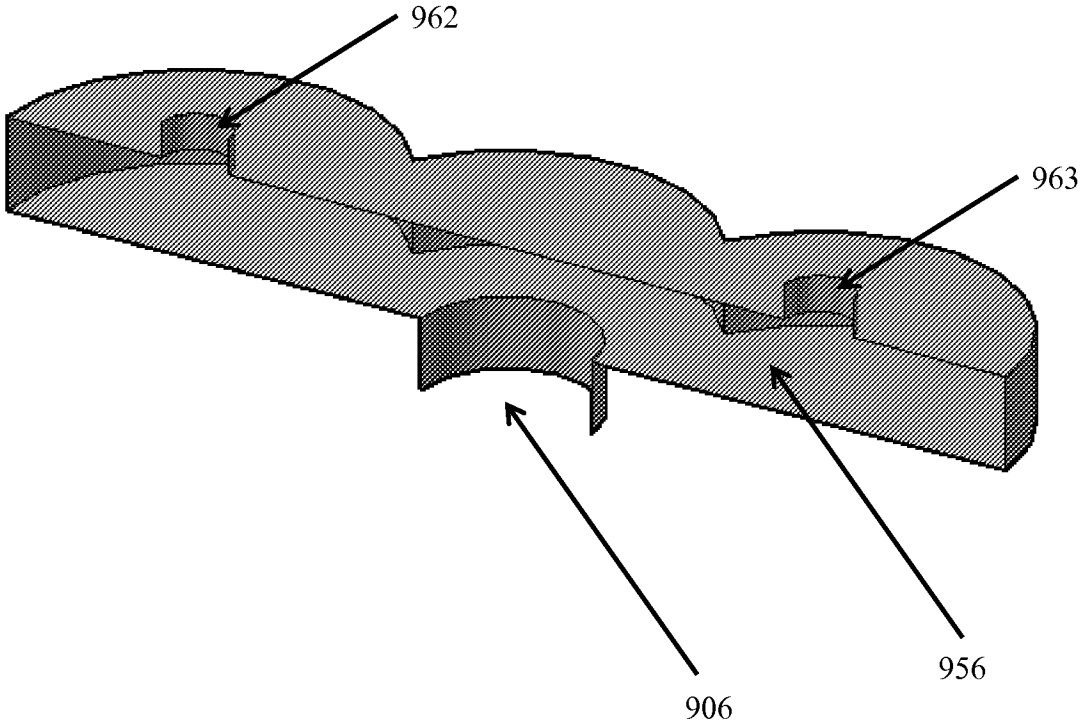

Referring now to FIGS. 11B and 11C it can be seen that the shape of the cavity 956 can be changed from a long and relatively straight configuration (FIG. 11B) to a configuration (FIG. 11C) with several curved notches. The shape of the cavity 956 can be changed, for example, to filter certain types and sizes of contaminants as opposed to other types and sizes. The shape and height of the cavity 956 can also be changed to affect acoustic response of the microphone assembly. Using these approaches, at least some contaminants may be contained within the baffle structure (e.g., they may adhere to or become somehow lodged in this structure).

Figure 12:
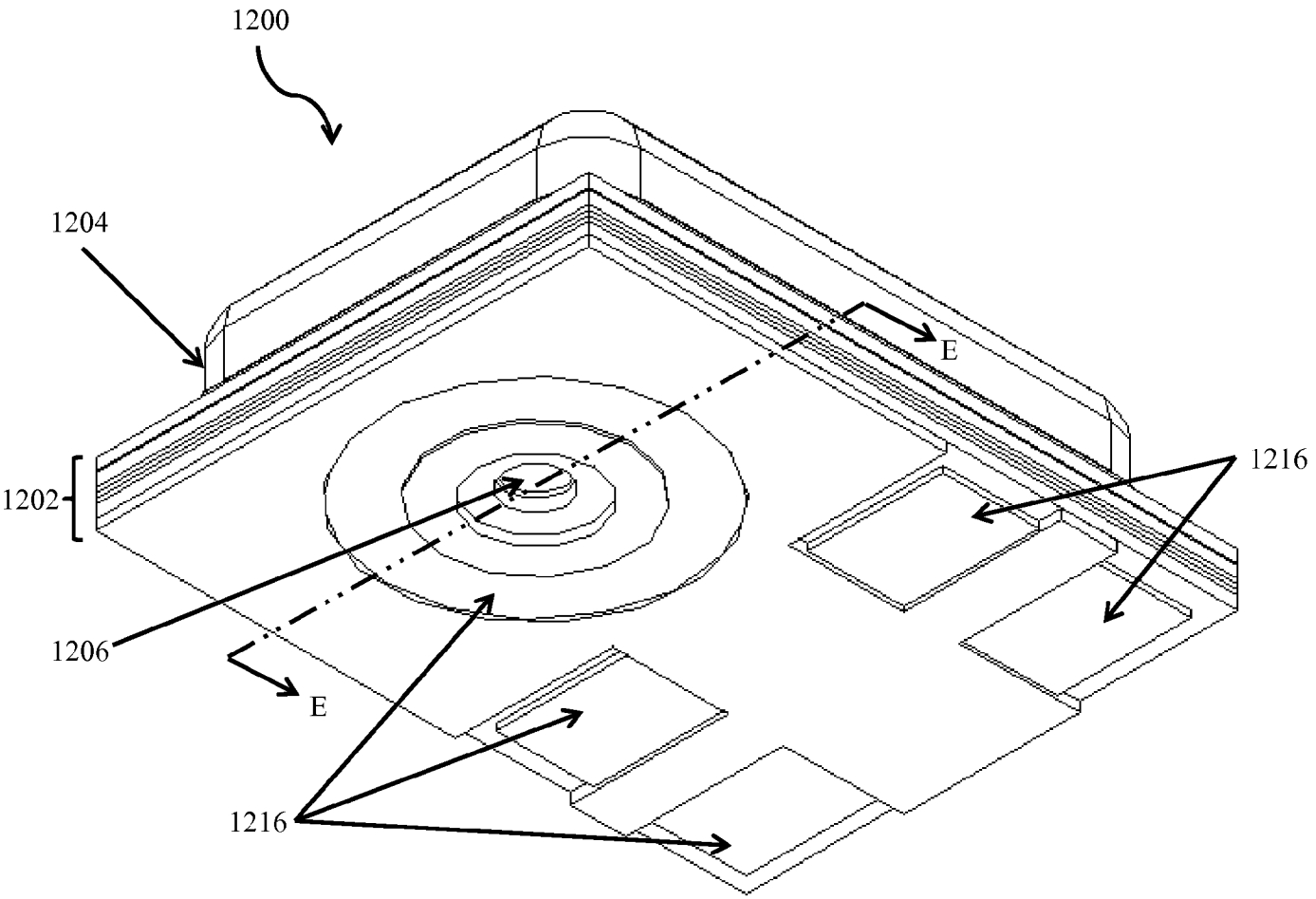
FIG. 12 comprises a perspective view of a MEMS assembly with barrier over port according to various embodiments of the present invention.
Figure 13:
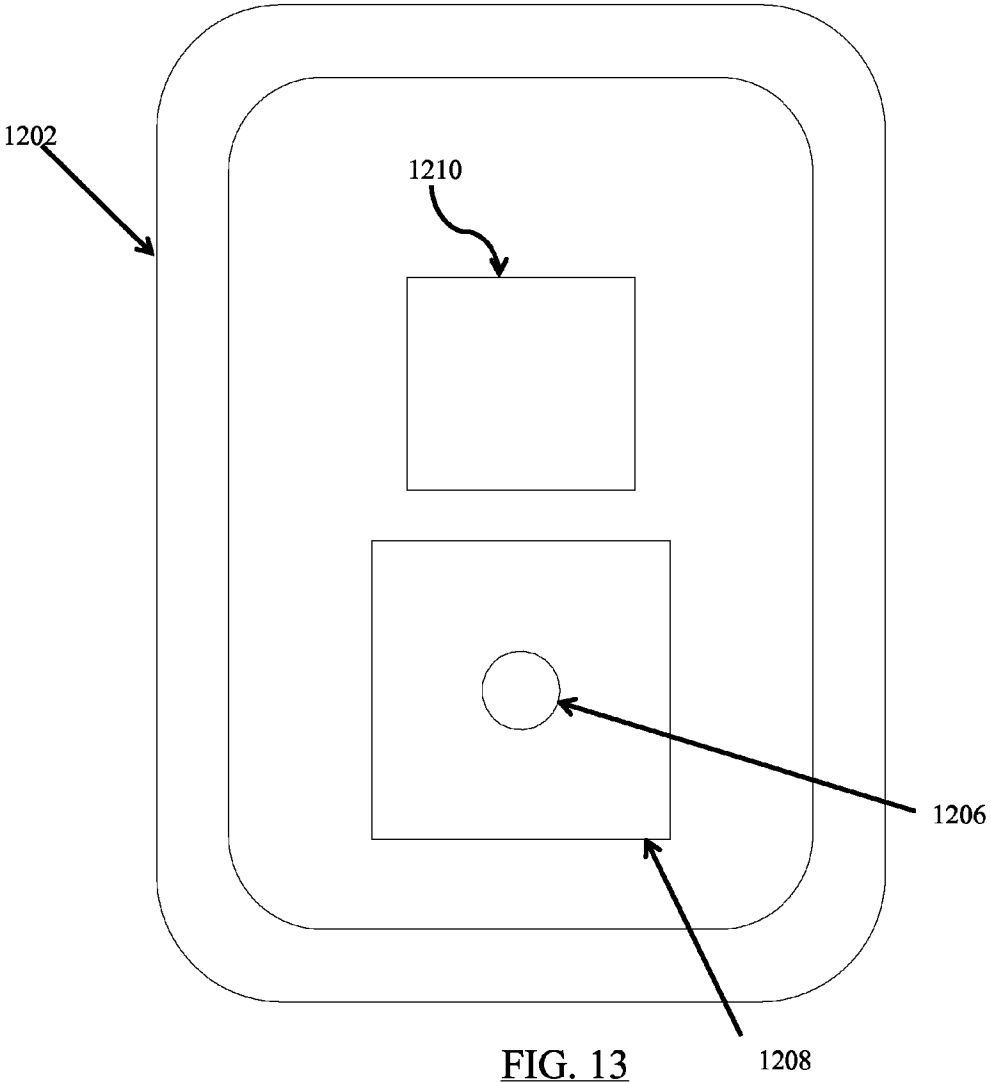
FIG. 13 comprises a top view of the base portion of the assembly of FIG. 12 according to various embodiments of the present invention.
Figure 14:
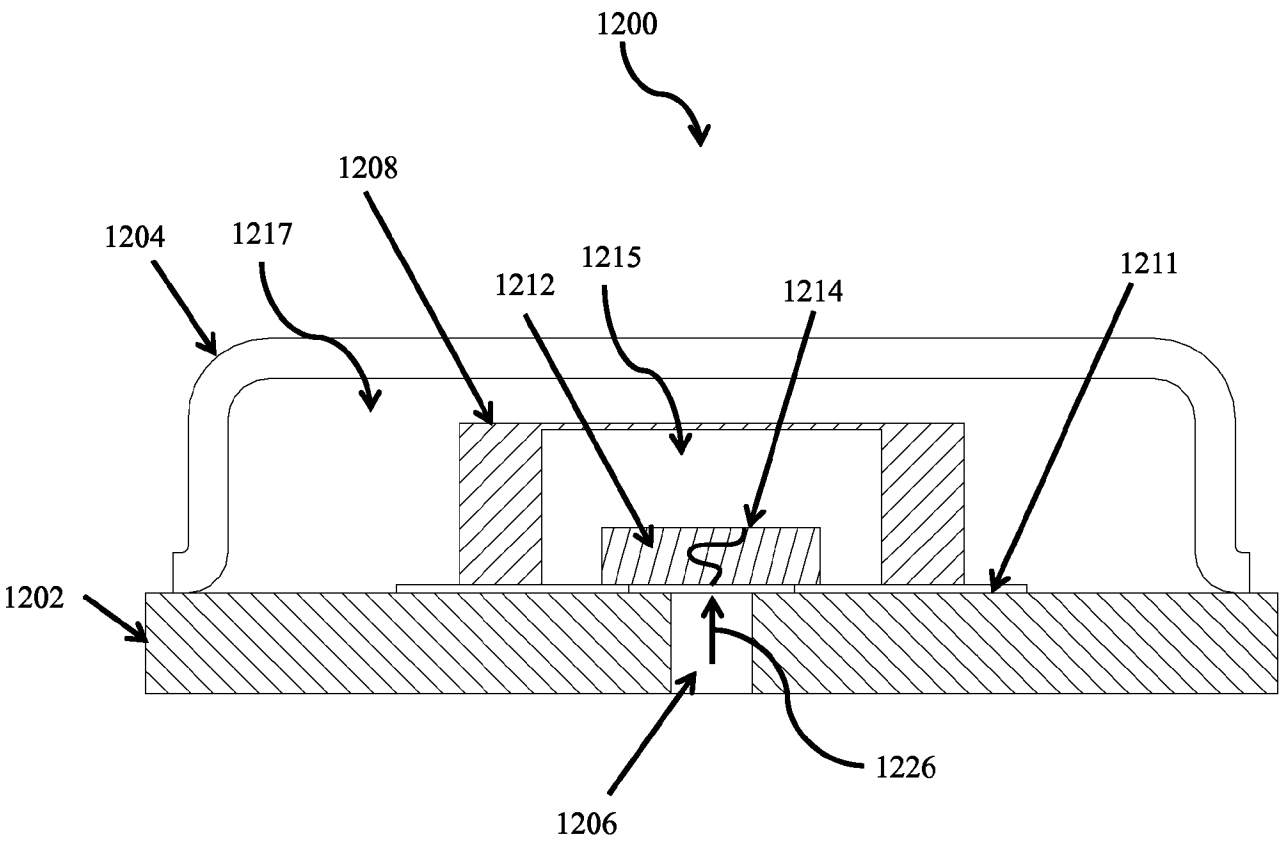
FIG. 14 comprises a cross-sectional perspective view taken along line E-E of the barrier of FIGS. 12 and 13 according to various embodiments of the present invention.

Referring now to FIGS. 12-14, another example of a MEMS assembly 1200 having a tortuous path for acoustic energy to prevent particulate infiltration is described. The assembly 1200 includes a base 1202, a lid 1204, a port 1206, a Microelectromechanical System (MEMS) apparatus 1208, a barrier 1212, and an integrated circuit 1210.

Generally speaking and as described elsewhere herein, each of the lid 1204 and base 1202 are formed of one or more layers of materials. For example, these components may be constructed of FR-4 boards and may have various conductive and insulating layers arranged around these boards.

The port 1206 extends through the base 1202 and the MEMS apparatus 1208 extends across the port. Conductive traces (not shown) couple the output of the integrated circuit 1210 to conductive pads 1216 on the base. A customer can make an electrical connection with these pads for further processing of the signal that is received from the integrated circuit 1210.

The MEMS apparatus 1208 receives acoustic energy which is transduced into electrical energy. In that respect, the MEMS apparatus 1208 may include a diaphragm and a back plate. Acoustic energy causes movement of the diaphragm and this varies the voltage between the diaphragm and the back plate. The resulting electrical signal that is produced represents the acoustic energy that has been received by the MEMS apparatus 1208. The MEMS apparatus 1208 is attached to the base by die attach adhesive 1211 or any other appropriate fastening mechanism or approach.

The integrated circuit 1210 is any kind of integrated circuit that performs any kind of processing function. In one example, the integrated circuit 1210 is a buffer or an amplifier. Other examples of integrated circuits are possible. Although only one integrated circuit is shown in this example, it will be appreciated that multiple integrated circuits may be deployed.

The barrier 1212 is in one aspect a silicon piece that extends across and over the port 1206 and within (under) the MEMS apparatus 1208. The barrier 1212 has an elongated tunnel 1214 with turns that acts as a particulate filter in the assembly 1200. The tunnel 1214 is an extended hollow opening (i.e., in the shape of a tube) through which sound traverses and can be created using a variety of different approaches such as stealth laser dicing and chemical etching. A path for sound is indicated by the arrow labeled 1226 and this follows and proceeds through the tunnel 1214. The barrier 1212 is disposed in the front volume 1215 and not the back volume 1217. Particulates will be trapped within, adhere with, or become lodged within the tunnel 1214 (e.g., at turns within the tunnel 1214) and thereby be prevented from entering the interior of the assembly 1200 but not completely obstructing the tunnel. This disposition of the barrier 1212 under the MEMS apparatus 1208 may improve the acoustic performance of the assembly 1500 by decreasing the front volume 1215 that would otherwise be present.

The barrier 1212 can have a wide variety of dimensions. In one illustrative example, the barrier 1212 is approximately 0.5 mm long by approximately 0.5 mm wide by approximately 0.15 mm thick. The tunnel 1214 can also have a variety of different shapes and dimensions.

Figure 15:
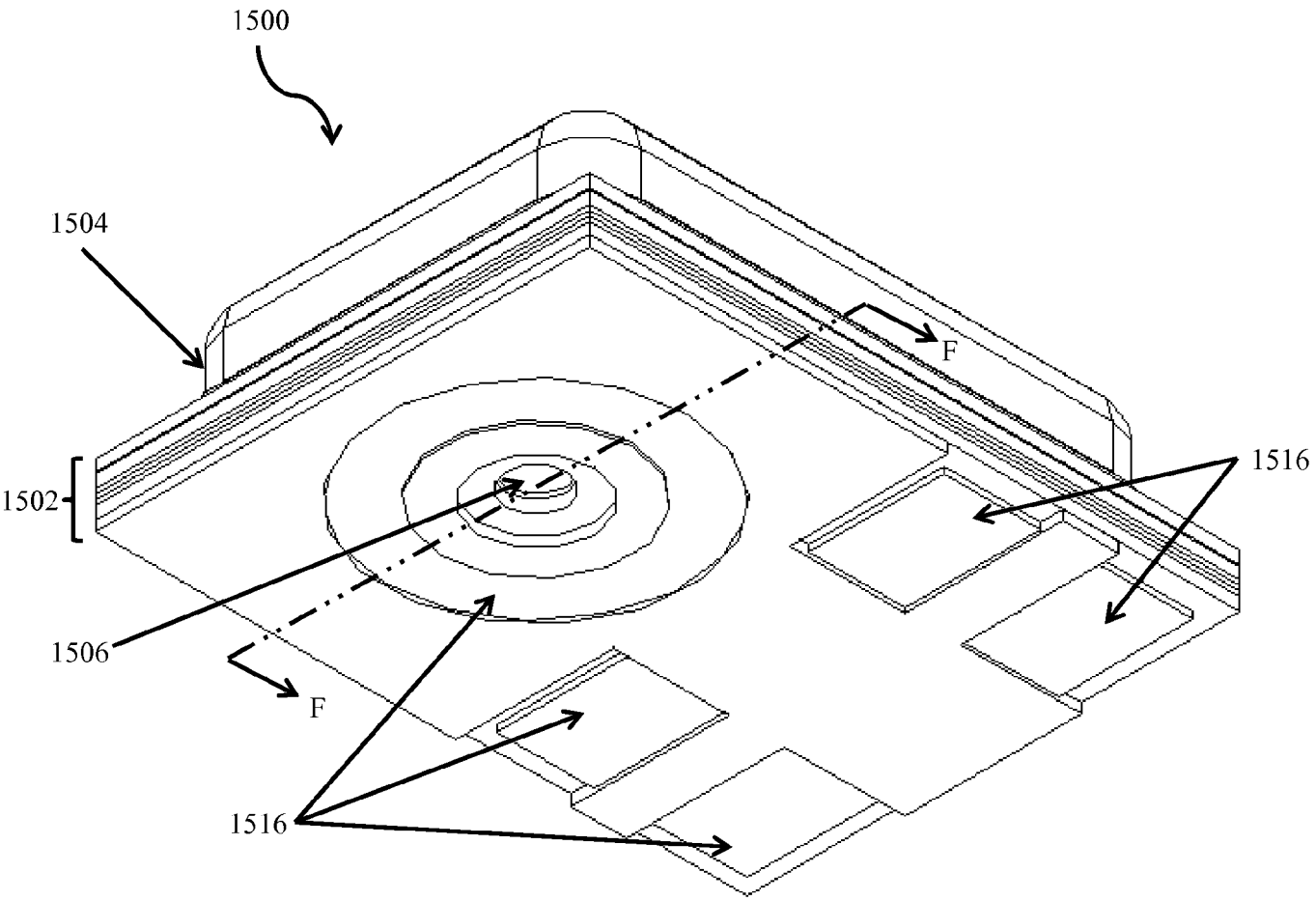
FIG. 15 comprises a perspective view of a MEMS assembly with barrier over port according to various embodiments of the present invention.
Figure 16:
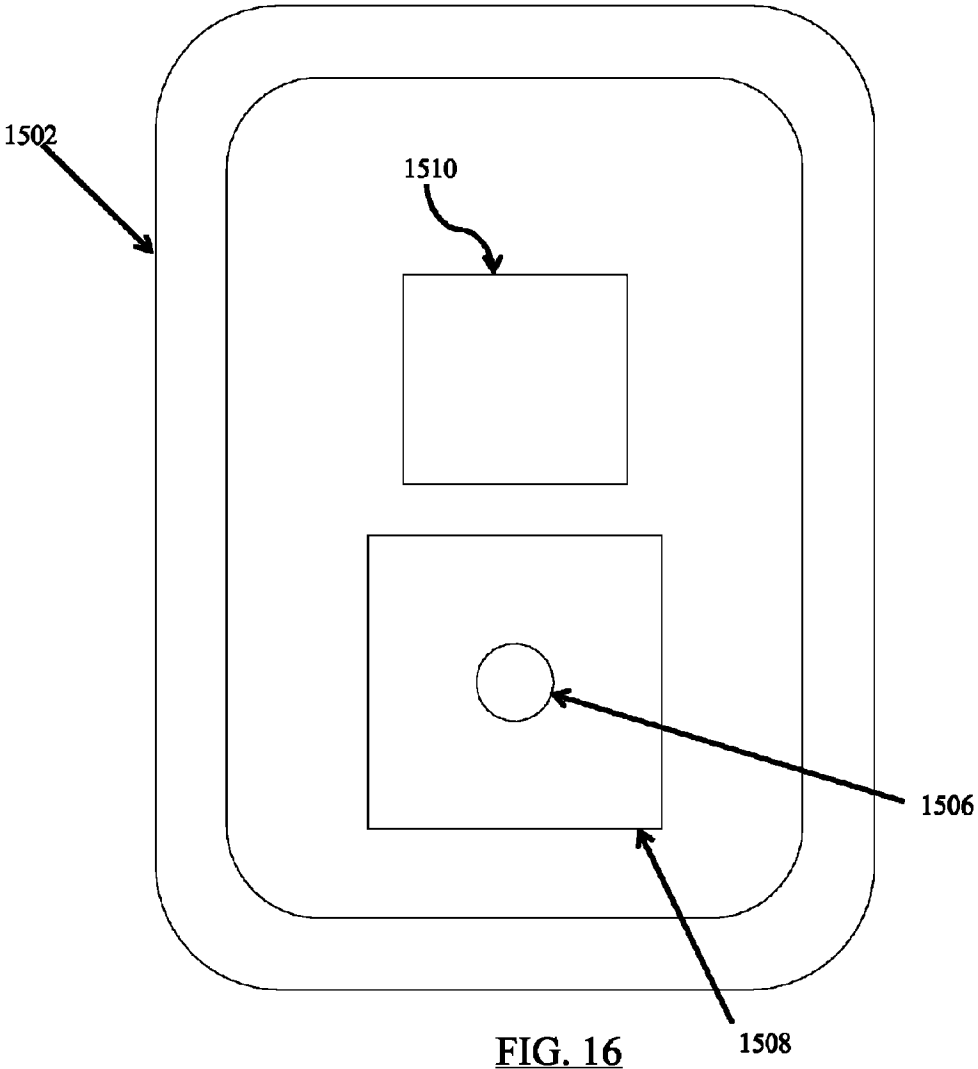
FIG. 16 comprises a top view of the base portion of the assembly of FIG. 15 according to various embodiments of the present invention.
Figure 17:
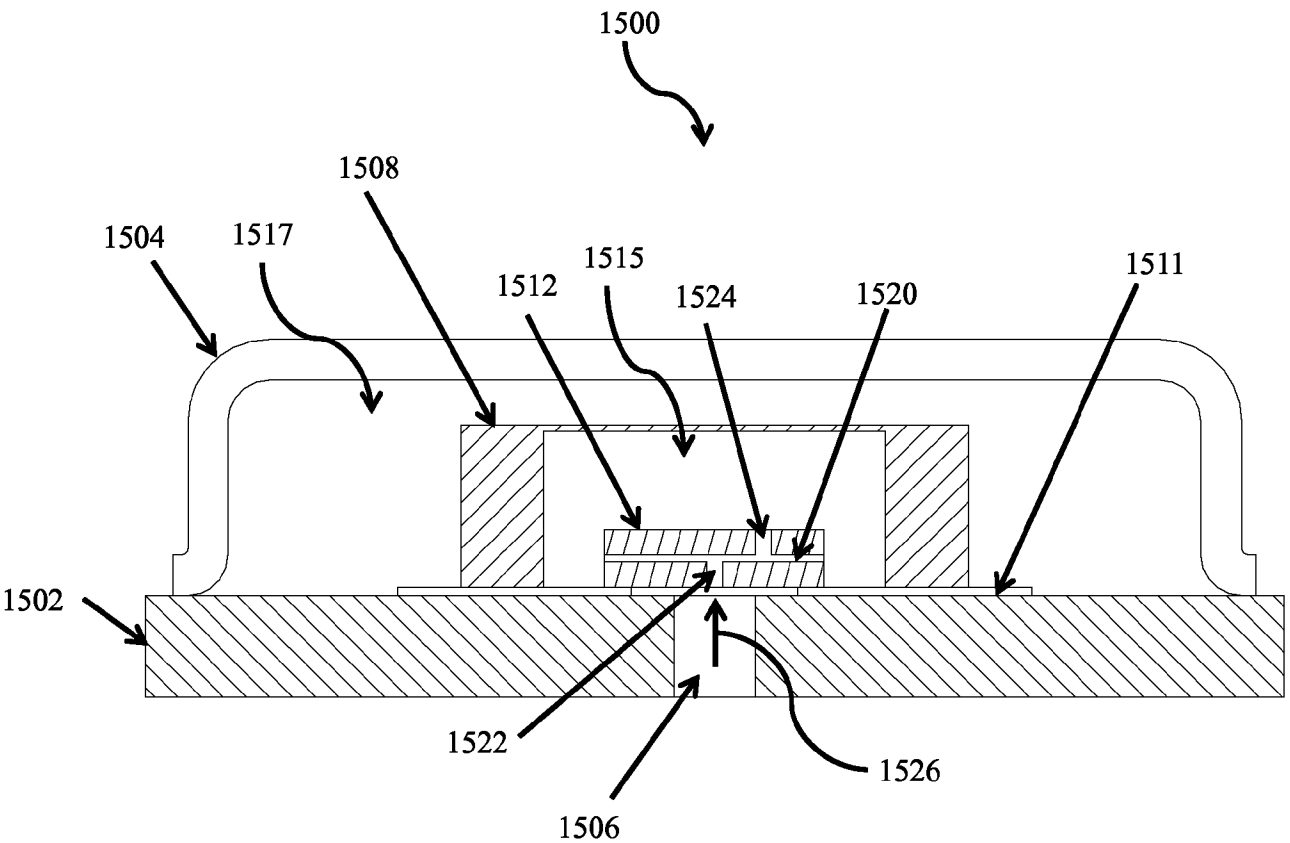
FIG. 17 comprises a cross-sectional perspective view taken along line F-F of the barrier of FIGS. 15 and 16 according to various embodiments of the present invention.

Referring now to FIGS. 15-17, another example of a MEMS assembly 1500 having a tortuous path for acoustic energy that prevents particulate infiltration in the assembly is described. The assembly 1500 includes a base 1502, a lid 1504, a port 1506, a Microelectromechanical System (MEMS) apparatus 1508, a barrier 1512, and an integrated circuit 1510.

Generally speaking and as described elsewhere herein, each of the lid 1504 and base 1502 are formed of one or more layers of materials. For example, these components may be constructed of FR-4 boards and may have various conductive and insulating layers arranged around these boards.

The port 1506 extends through the base 1502 and the MEMS apparatus 1508 extends across the port 1506. Conductive traces (not shown) couple the output of the integrated circuit 1510 to conductive pads 1516 on the base. A customer can make an electrical connection with these pads for further processing of the signal that is received from the integrated circuit 1510.

The MEMS apparatus 1508 receives acoustic energy which is transduced into electrical energy. In that respect, the MEMS apparatus 1508 may include a diaphragm and a back plate. Acoustic energy causes movement of the diaphragm and this varies the charge between the diaphragm and the back plate. The resulting electrical signal that is produced represents the acoustic energy that has been received by the MEMS apparatus 1508. The MEMS apparatus 1508 is attached to the base by die attach adhesive 1511 or any other appropriate fastening mechanism or approach.

The integrated circuit 1510 is any kind of integrated circuit that performs any kind of processing function. In one example, the integrated circuit 1510 is a buffer or an amplifier. Other examples of integrated circuits are possible. Although only one integrated circuit is shown in this example, it will be appreciated that multiple integrated circuits may be deployed.

The barrier 1512 is in one aspect a silicon piece that extends across and over the port 1506 and within (under) the MEMS apparatus 1508. The barrier 1512 includes a tunnel 1520 (that can be a curved tunnel or a straight tunnel). Communicating with the tunnel 1520 is a first trench 1522 and a second trench 1524. A sound path (the arrow with the label 1526) is shown for sound entering the port 1506, passing through the first trench 1522, moving through the horizontal tunnel 1520, moving through the second trench 1524, and then being received at the MEMS apparatus 1508. The tunnel 1520 can be created by various approaches, for example, by stealth laser dicing or chemical etching. The trenches 1522 and 1524 can be created, for instance, by dry etching approaches. The long path created as sound traverses the trenches and tunnel acts as a particle filter. This disposition of the barrier 1512 beneath the MEMS apparatus 1508 may improve the acoustic performance of the assembly 1500 by decreasing the front volume that would otherwise be present.

The barrier 1512 can have a wide variety of dimensions. In one illustrative example, the barrier 1512 is approximately 0.5 mm long by approximately 0.5 mm wide by approximately 0.15 mm thick.

Figure 18:
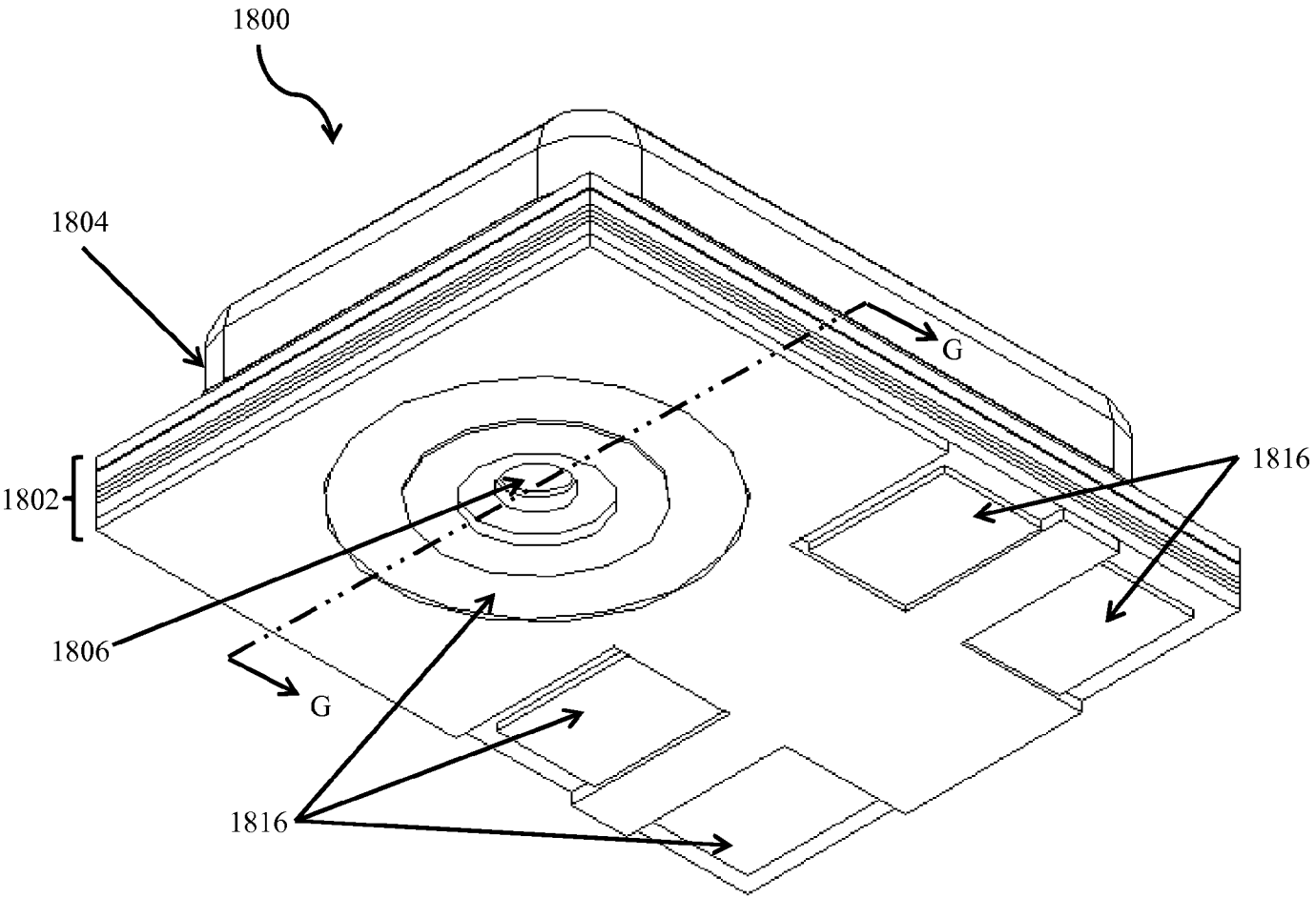
FIG. 18 comprises a perspective view of a MEMS assembly with barrier over port according to various embodiments of the present invention.
Figure 19:
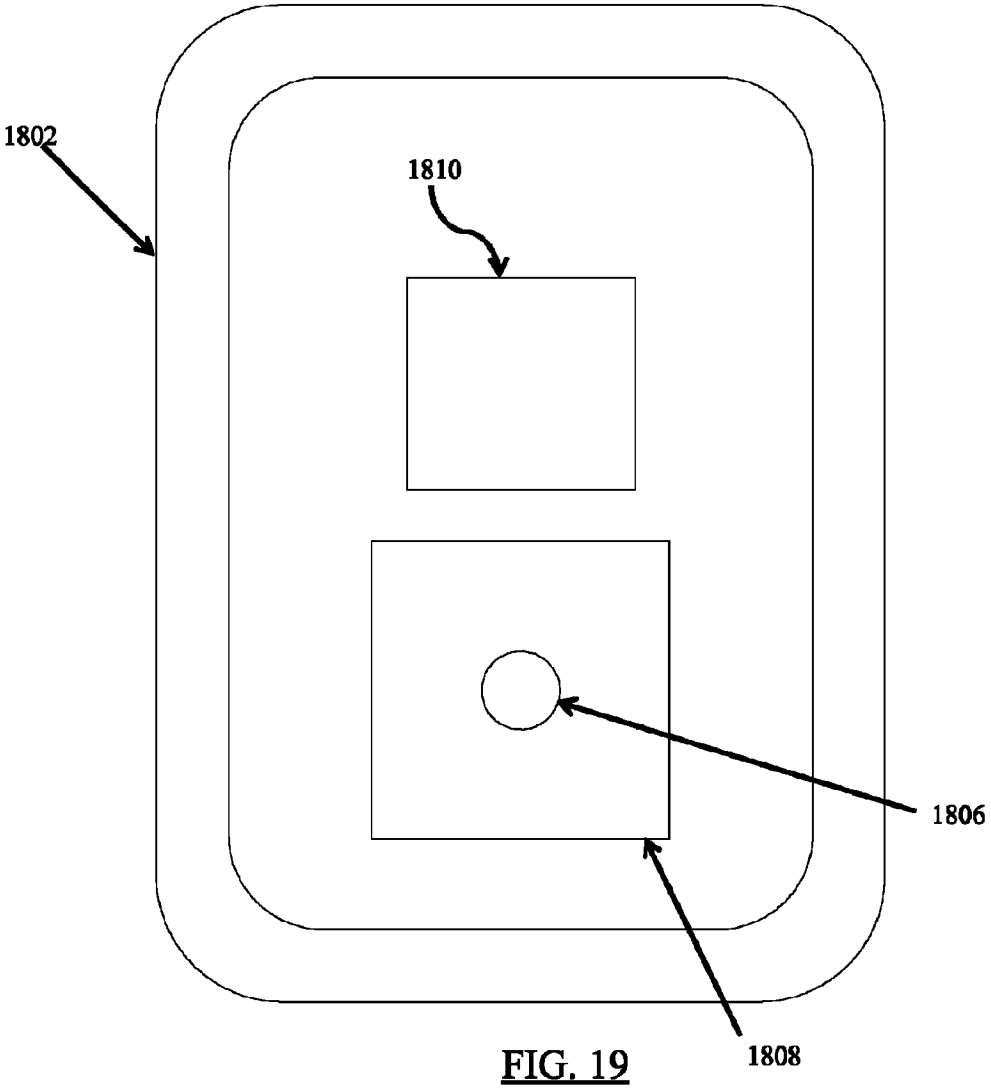
FIG. 19 comprises a top view of the base portion of the assembly of FIG. 18 according to various embodiments of the present invention.
Figure 20:
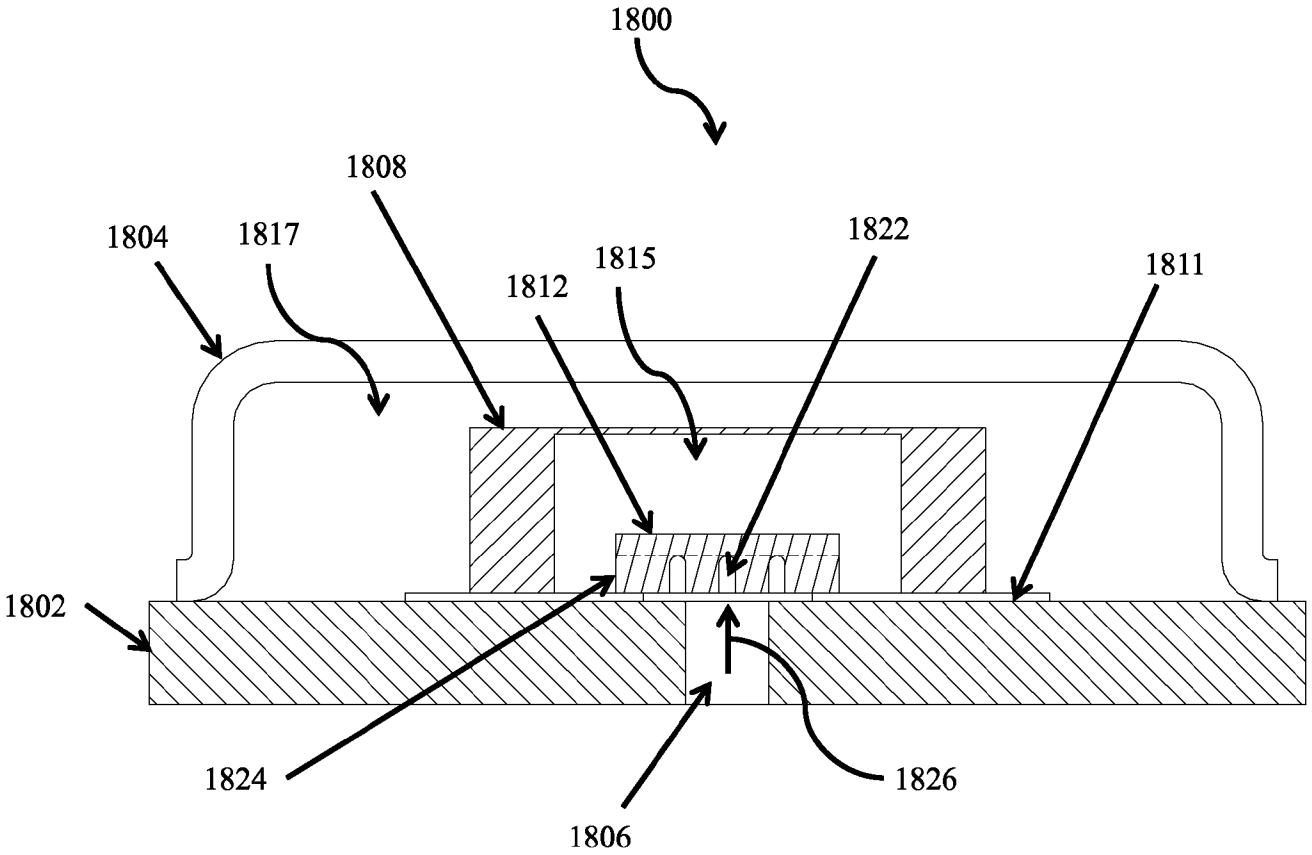
FIG. 20 comprises a cross-sectional perspective view taken along line G-G of the barrier of FIGS. 18 and 19 according to various embodiments of the present invention.

Referring now to FIGS. 18-20, another example of a MEMS assembly 1800 having a tortuous path for acoustic energy that provides protection for particulate infiltration is described. The assembly 1800 includes a base 1802, a lid 1804, a port 1806, a Microelectromechanical System (MEMS) apparatus 1808, a barrier 1812, and an integrated circuit 1810.

Generally speaking and as described elsewhere herein, each of the lid 1804 and base 1802 are formed of one or more layers of materials. For example, these components may be constructed of FR-4 boards and may have various conductive and insulating layers arranged around these boards.

The port 1806 extends through the base 1802 and the MEMS apparatus 1808 extends across the port. Conductive traces (not shown) couple the output of the integrated circuit 1810 to conductive pads 1816 on the base. A customer can make an electrical connection with these pads for further processing of the signal that is received from the integrated circuit 1810.

The MEMS apparatus 1808 receives acoustic energy which is transduced into electrical energy. In that respect, the MEMS apparatus 1808 may include a diaphragm and a back plate. Acoustic energy causes movement of the diaphragm and this varies the voltage between the diaphragm and the back plate. The resulting electrical signal that is produced represents the acoustic energy that has been received by the MEMS apparatus 1808. The MEMS apparatus 1808 is attached to the base by die attach adhesive 1811 or any other appropriate fastening mechanism or approach.

The integrated circuit 1810 is any kind of integrated circuit that performs any kind of processing function. In one example, the integrated circuit 1810 is a buffer or an amplifier. Other examples of integrated circuits are possible. Although only one integrated circuit is shown in this example, it will be appreciated that multiple integrated circuits may be deployed.

The barrier 1812 is in one aspect a silicon piece that extends across and over the port 1806 and within (under) the MEMS apparatus 1808. The barrier 1812 has a first trench 1822 and a second trench 1824. A sound path 1826 is shown for sound. The trenches 1822 and 1824 are etched in silicone in an intersecting pattern. So, as air hits the bottom of the silicone barrier 1812 it exits out the side.

The trenches 1822 and 1824 can be created, for example, by dry etching approaches. The long path created acts as a particle filter. The barrier 1812 is in the front volume 1815 and not the back volume 1817. This disposition of the barrier 1812 beneath the MEMS apparatus 1808 may improve the acoustic performance of the assembly 1800 by decreasing the front volume that otherwise would be present.

The barrier 1812 can have a wide variety of dimensions. In one illustrative example, the barrier 1812 is approximately 0.5 mm wide by approximately 0.5 mm long by approximately 0.15 mm thick. When used in top port devices, the same material may provide an acoustic resistance that is used to flatten the frequency response of the top port device.

Figure 21:
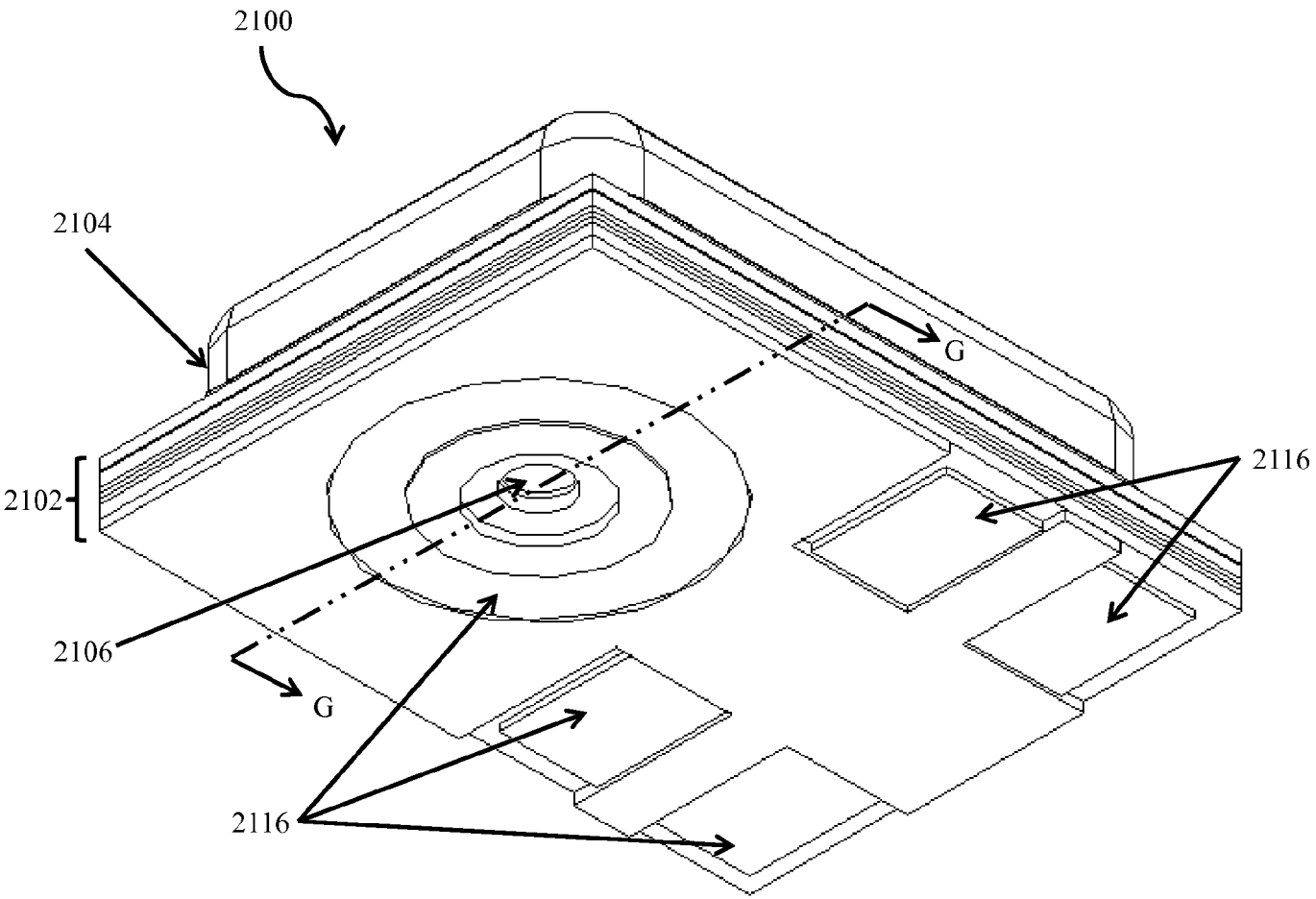
FIG. 21 comprises a perspective view of a MEMS assembly with barrier over port according to various embodiments of the present invention.
Figure 22:
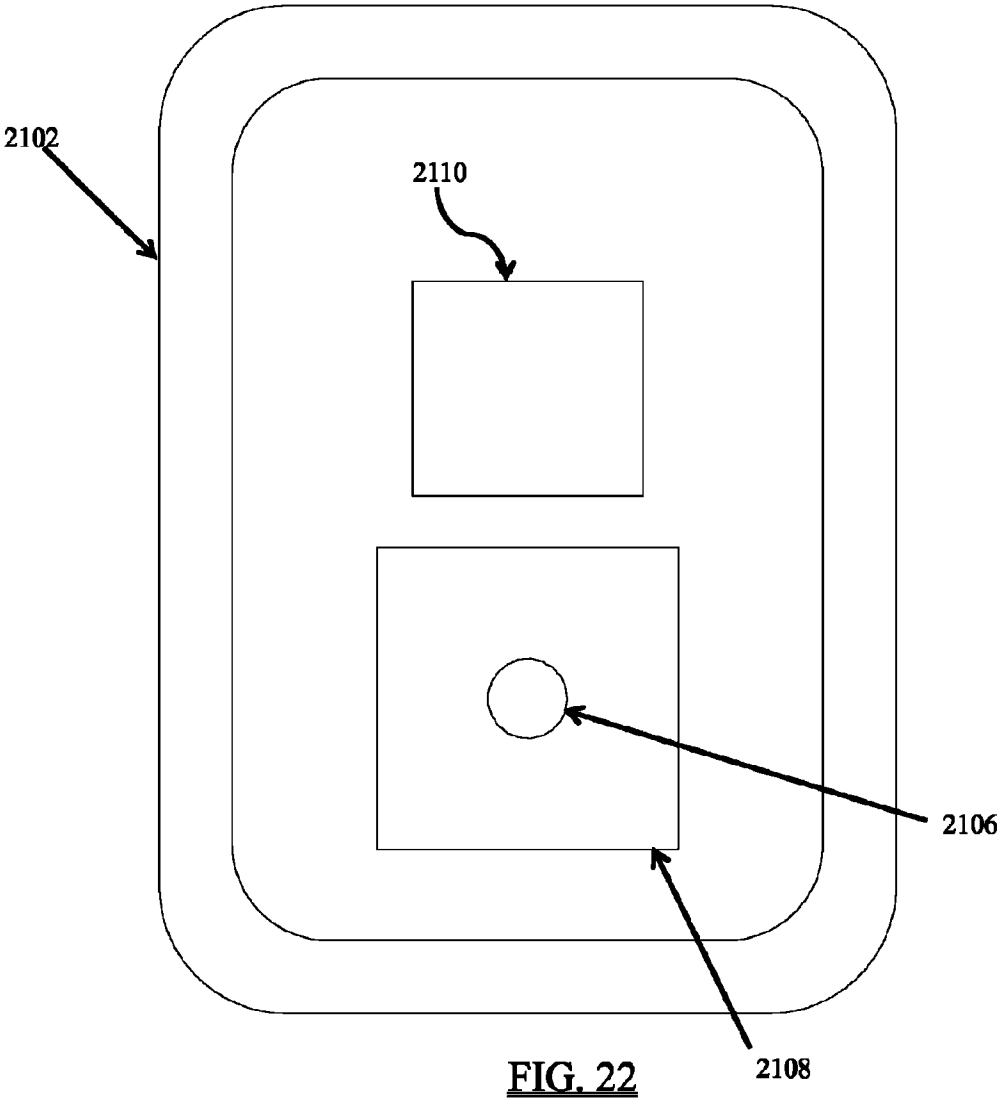
FIG. 22 comprises a top view of the base portion of the assembly of FIG. 21 according to various embodiments of the present invention.
Figure 23:
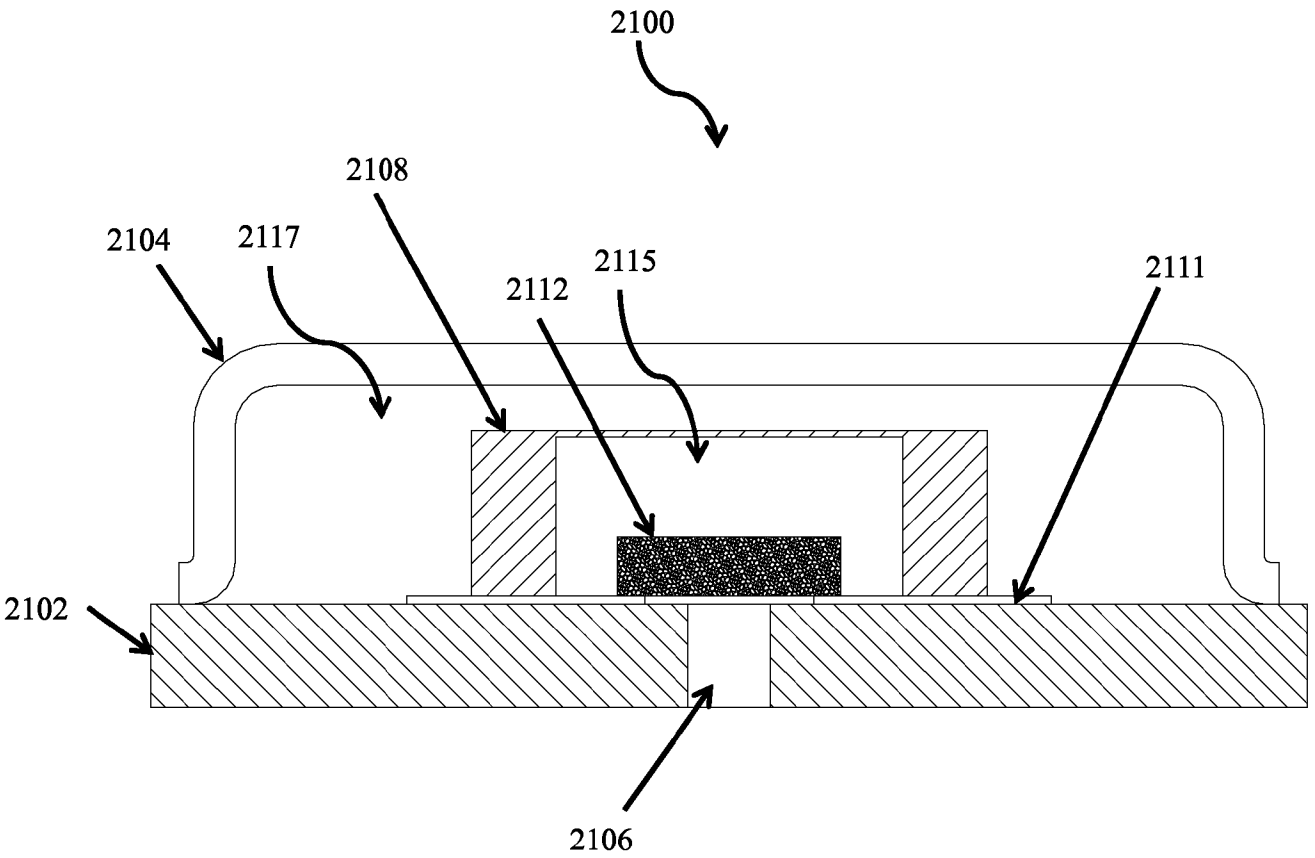
FIG. 23 comprises a cross-sectional perspective view taken along line H-H of the barrier of FIGS. 21 and 22 according to various embodiments of the present invention.

Referring now to FIGS. 21-23, another example of a MEMS assembly 2100 having a tortuous path barrier path for acoustic energy is described. The assembly 2100 includes a base 2102, a lid 2104, a port 2106, a Microelectromechanical System (MEMS) apparatus 2108, a barrier 2112, and an integrated circuit 2110.

Generally speaking and as described elsewhere herein, each of the lid 2104 and base 2102 are formed of one or more layers of materials. For example, these components may be constructed of FR-4 boards and may have various conductive and insulating layers arranged around these boards.

The port 2106 extends through the base 2102 and the MEMS apparatus 2108 extends across the port. Conductive traces (not shown) couple the output of the integrated circuit 2110 to conductive pads 2116 on the base. A customer can make an electrical connection with these pads 2116 for further processing of the signal that is received from the integrated circuit 2110.

The MEMS apparatus 2108 receives acoustic energy and converts the acoustic energy into electrical energy. In that respect, the MEMS apparatus 2108 may include a diaphragm and a back plate. Acoustic energy causes movement of the diaphragm and this varies the voltage between the diaphragm and the back plate. The resulting electrical signal that is produced represents the acoustic energy that has been received by the MEMS apparatus 2108. The MEMS apparatus 2108 is attached to the base by die attach adhesive 2111 or any other appropriate fastening mechanism or approach.

The integrated circuit 2110 is any kind of integrated circuit that performs any kind of processing function. In one example, the integrated circuit 2110 is a buffer or an amplifier. Other examples of integrated circuits are possible. Although only one integrated circuit is shown in this example, it will be appreciated that multiple integrated circuits may be deployed.

In one aspect, the barrier 2112 is a piece of porous ceramic material with approximately 1-100 micrometer pore sizes or more preferably 2-20 micrometer pore sizes that are effective as a particle filter. In other words, sound can pass through the pores, but larger particulates are prevented from passing. The barrier 2112 can have a wide variety of dimensions. In one illustrative example, the barrier 2112 is approximately 0.5 mm long by approximately 0.5 mm wide by approximately 0.25 mm thick placed under the MEMS apparatus 2108 in the cavity over the port 2106. It will be appreciated that the barrier 2112 is in the front volume 2115 and not the back volume 2117. This disposition of the barrier 2112 beneath the MEMS apparatus 2108 may improve the acoustic performance of the assembly 2100 by decreasing the front volume that would otherwise be present.

In one example, a thin impervious layer constructed, for example, from sprayed on lacquer or stamp transferred adhesive that is added to the upper surface of the barrier 2112 so that a vacuum can handle the pieces as it provides a sealing surface which vacuum tooling can latch onto. The thin impervious layer is advantageously viscous during application so not to wick into the porous ceramic.

Figure 24:
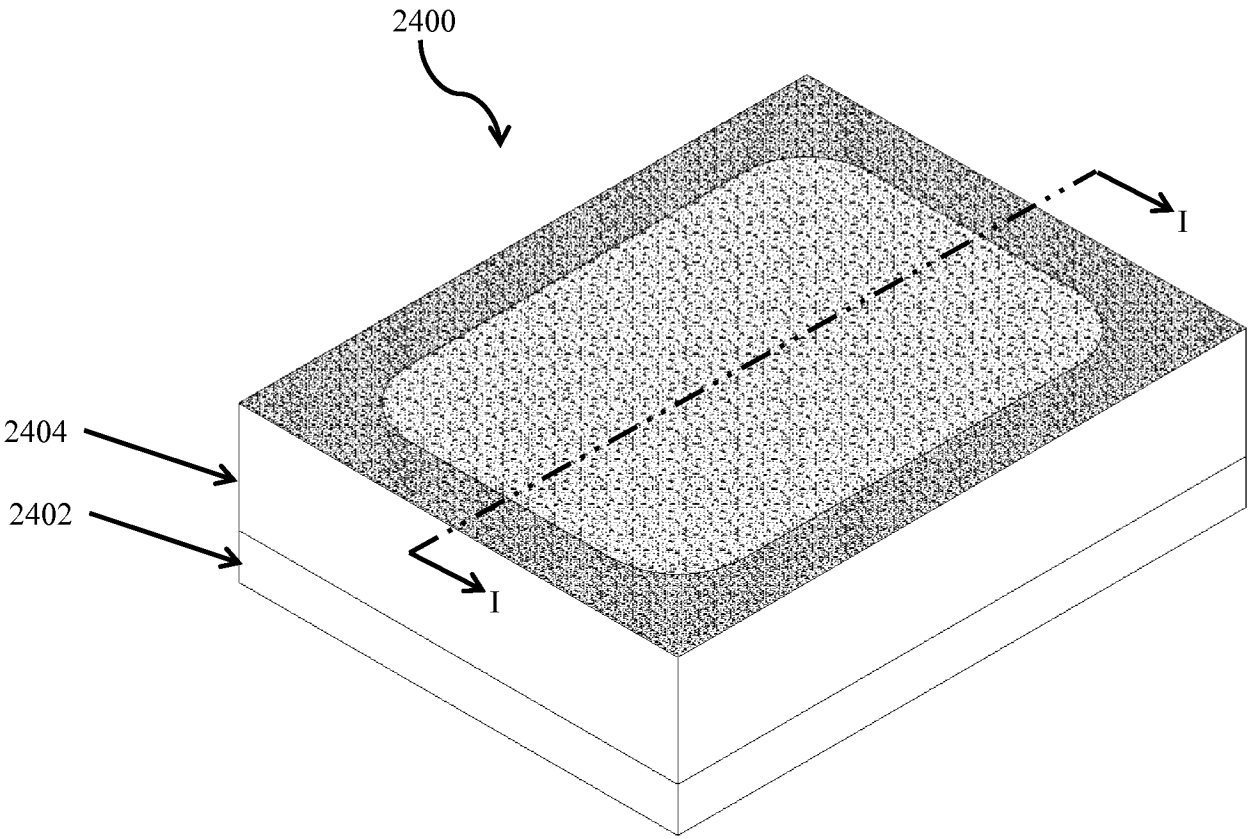
FIG. 24 comprises a perspective view of a MEMS assembly with barrier without a port according to various embodiments of the present invention.
Figure 25:
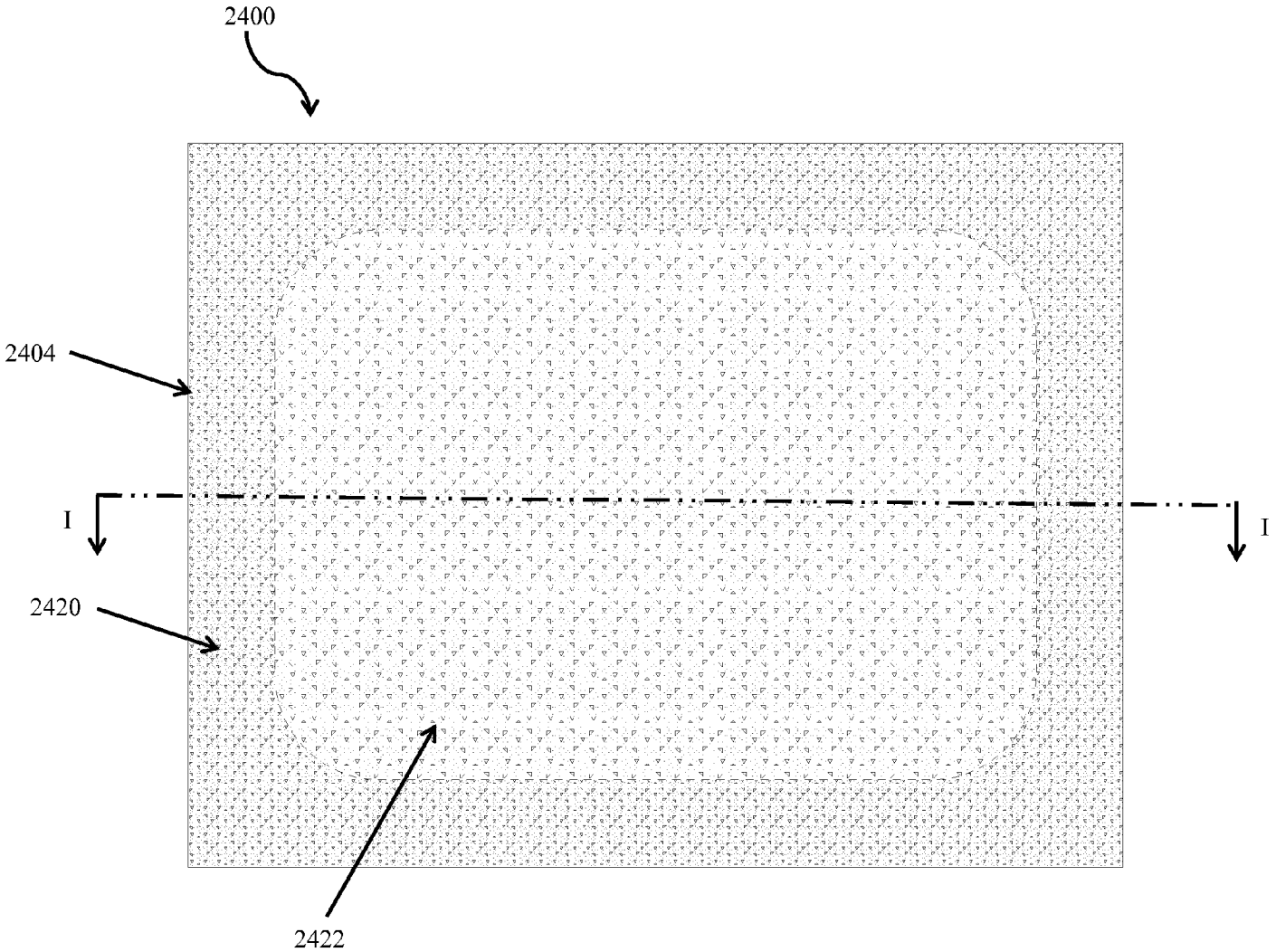
FIG. 25 comprises a top view of the base portion of the lid of FIG. 24 according to various embodiments of the present invention.
Figure 26:
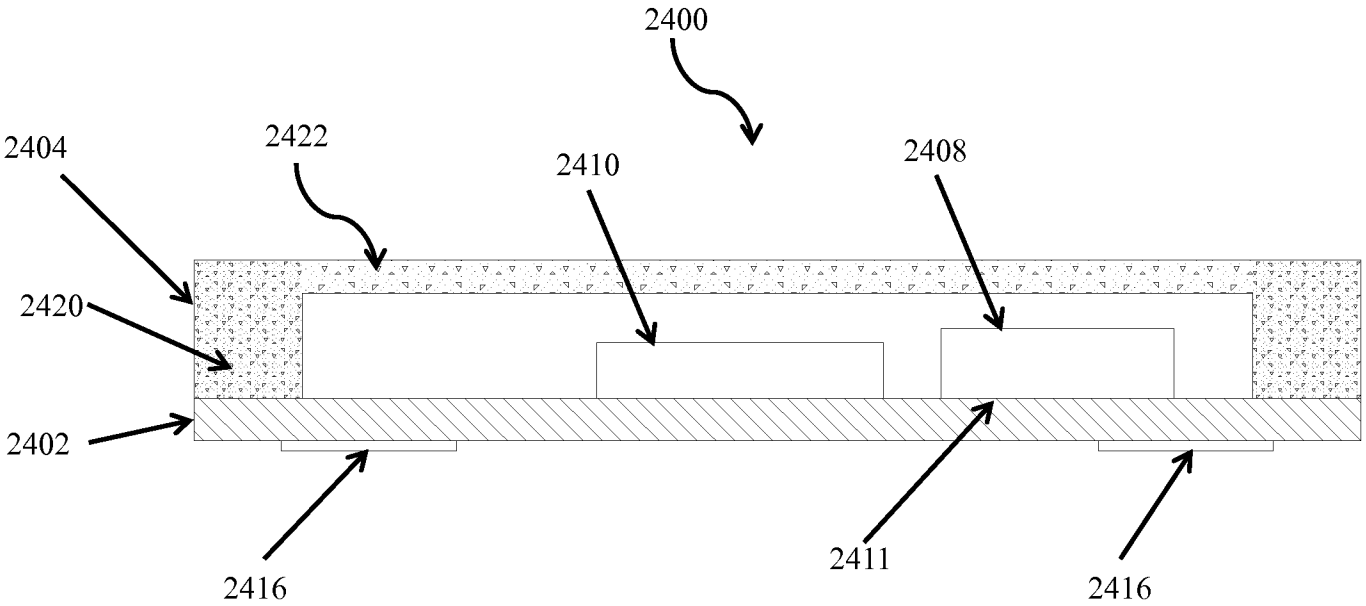
FIG. 26 comprises a cross-sectional perspective view taken along line I-I of the barrier of FIGS. 24 and 25 according to various embodiments of the present invention.

Referring now to FIGS. 24-26, another example of an assembly 2400 that utilizes a particulate filter or barrier is described. The assembly 2400 includes a base 2402, a lid 2404, a Microelectromechanical System (MEMS) apparatus 2408, and an integrated circuit 2410. There is no dedicated port. Instead, sound enters through the portion of the lid 2422 (which is porous) into the MEMS apparatus 2408. The structure of the lid 2404 is described in greater detail below.

Generally speaking and as described elsewhere herein, each of the lid 2404 and base 2402 are formed of one or more layers of materials. For example, these components may be constructed of FR-4 boards and may have various conductive and insulating layers arranged around these boards or ceramics or metals Conductive traces (not shown) couple the output of the integrated circuit 2410 to conductive pads 2416 on the base. A customer can make an electrical connection with these pads 2416 for further processing of the signal that is received from the integrated circuit 2410.

The MEMS apparatus 2408 receives acoustic energy and transduces it into electrical energy. In that respect, the MEMS apparatus 2408 may include a diaphragm and a back plate. Acoustic energy causes movement of the diaphragm and this varies the voltage between the diaphragm and the back plate. The resulting electrical signal that is produced represents the acoustic energy that has been received by the MEMS apparatus 2408. The MEMS apparatus 2408 is attached to the base by die attach adhesive 2411 or any other appropriate fastening mechanism or approach.

The integrated circuit 2410 is any kind of integrated circuit that performs any kind of processing function. In one example, the integrated circuit 2410 is a buffer or an amplifier. Other examples of integrated circuits are possible. Although only one integrated circuit is shown in this example, it will be appreciated that multiple integrated circuits may be deployed.

The lid 2404 includes a fused portion 2420 and a partially fused portion 2422. The fused portion 2420 includes a sealing surface 2426 that provides an acoustic seal with the base 2402. The partially fused portion 2422 provides an acoustic portion. That is, the partially fused portion 2422 allows sound to pass but prevents particulates from entering. By "fused," it is meant the media is melted to the point of complete coalescence containing no voids. By "partially fused," it is meant that the media is melted to the point of partial coalescence containing voids. The partially fused (or sintered) structure provides a tortuous path making debris and liquid ingress into the interior of the assembly difficult or impossible.

It will be appreciated that the porosity of the material used to construct the lid 2402 can be modified to flatten (via dampening) the frequency response of the microphone assembly. The lid 2402 can be constructed of metal to provide protection against radio frequency interference (RFI). As mentioned, it will be appreciated that this approach does not include a port hole or opening that necessarily extends entirely through either the base or the lid; rather, this approach includes a porous, tortuous path for entry of sound into the assembly. In addition, the lid 2402 can be coated with a hydrophobic coating to increase its resistance to liquid water penetration.

Figure 27:
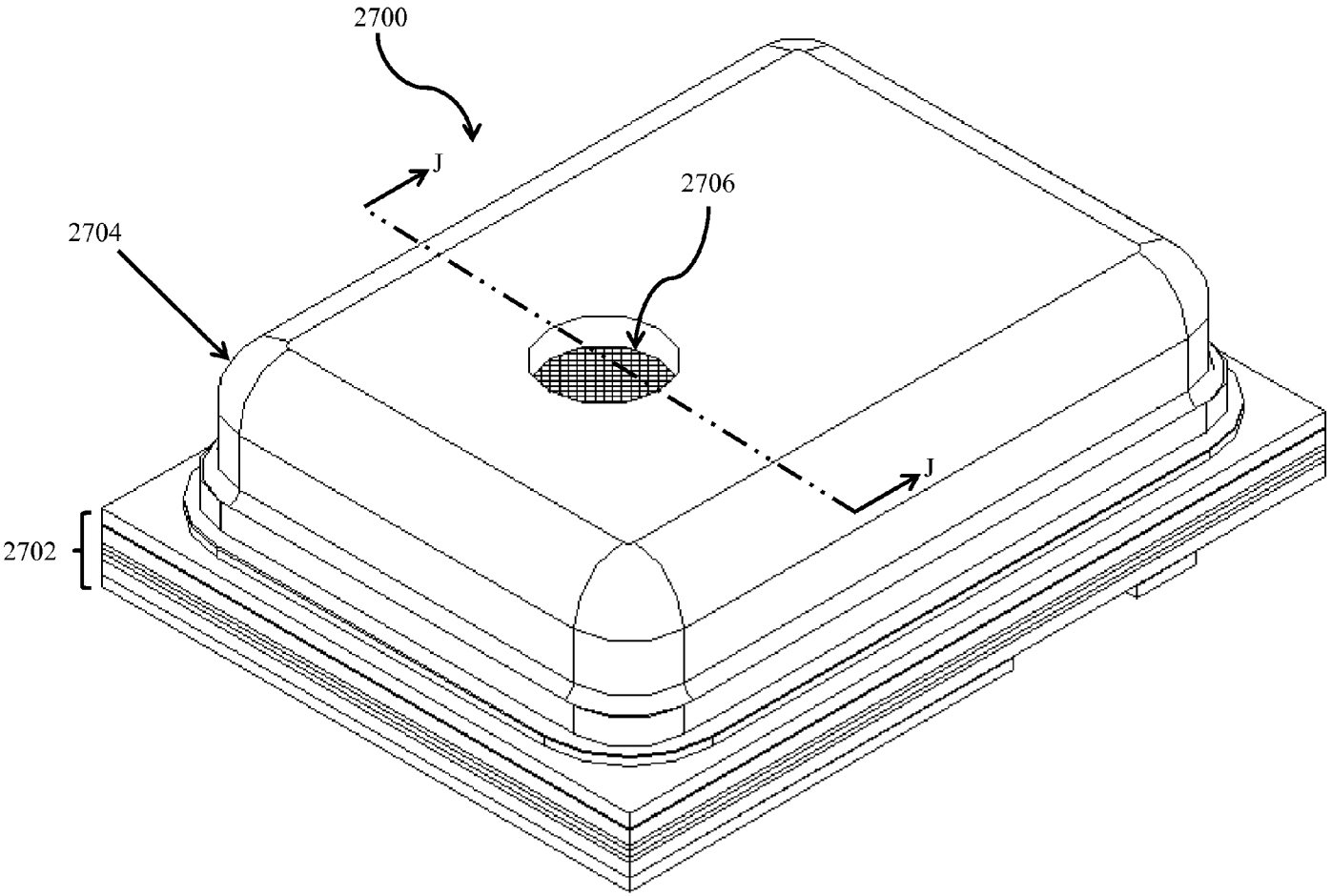
FIG. 27 comprises a perspective view of a MEMS assembly with barrier without a port according to various embodiments of the present invention.
Figure 28:
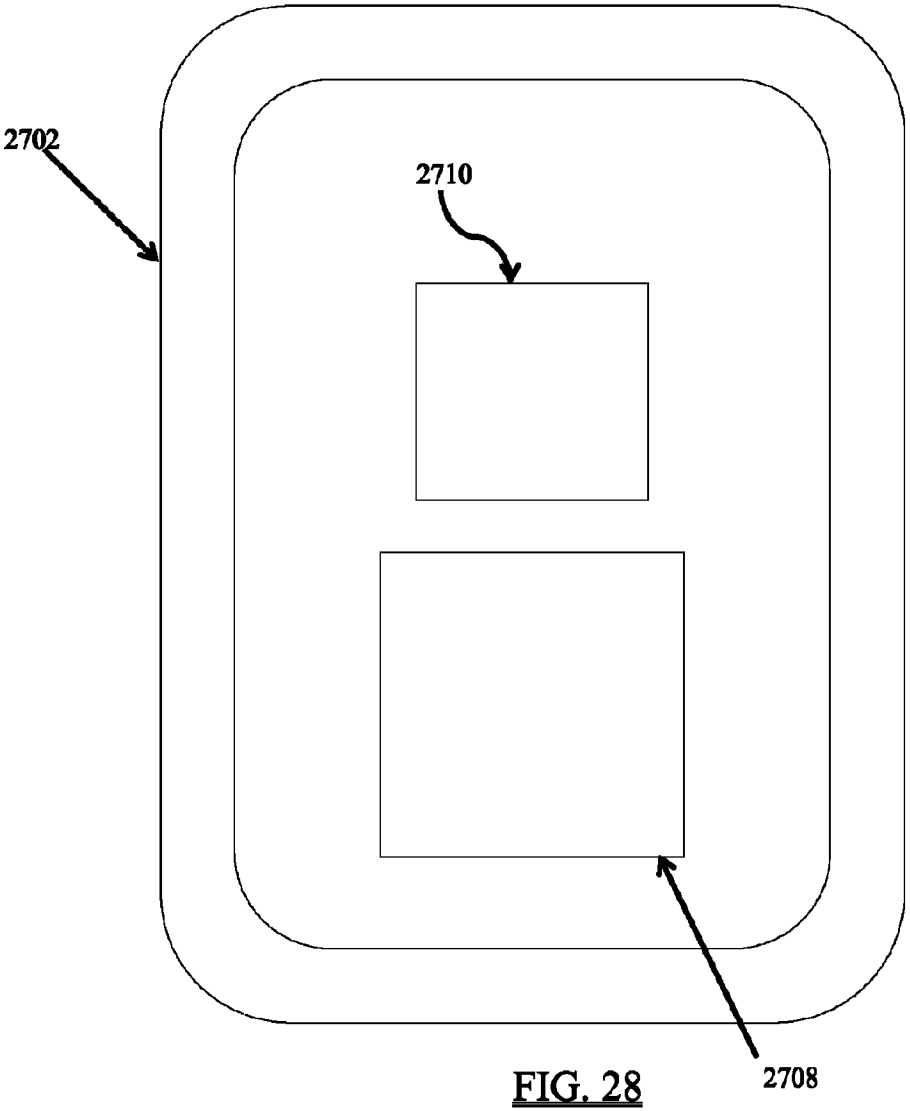
FIG. 28 comprises a top view of the base portion of the assembly of FIG. 27 according to various embodiments of the present invention.
Figure 29:
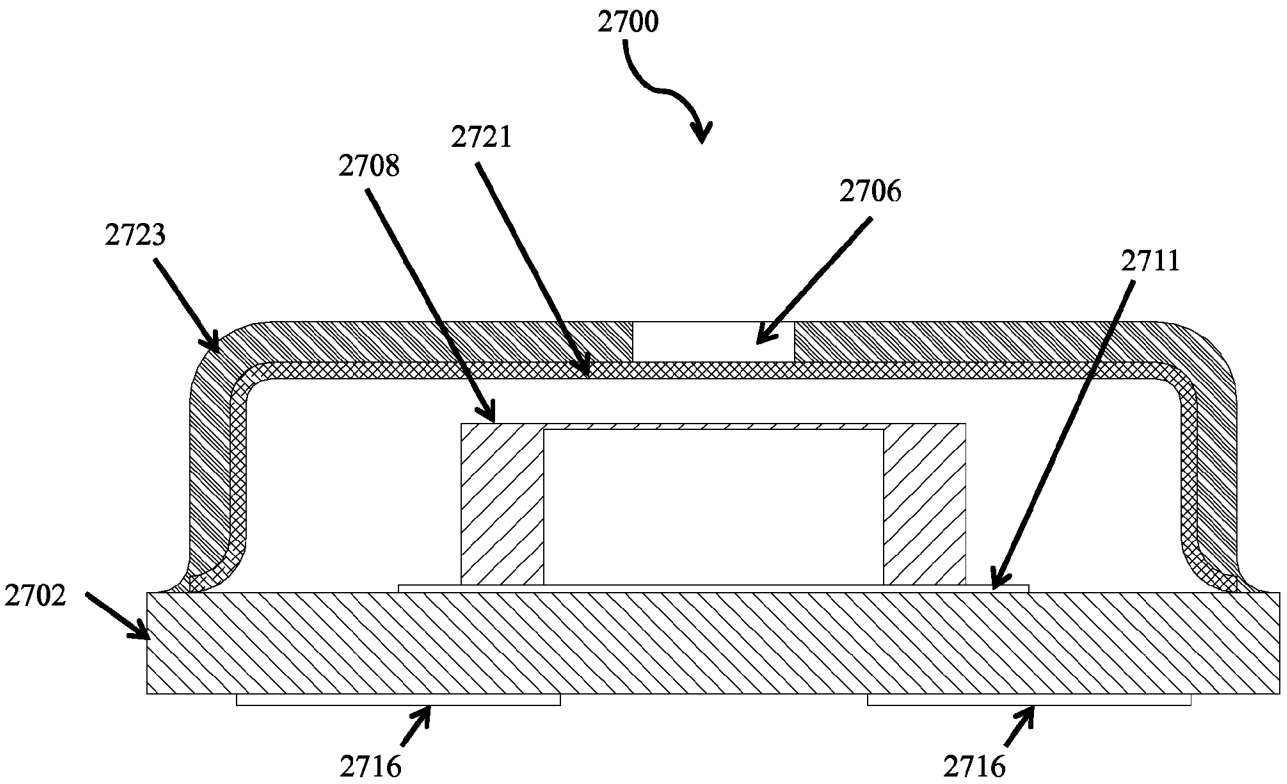
FIG. 29 comprises a cross-sectional perspective view taken along line J-J of the barrier of FIGS. 27 and 28 according to various embodiments of the present invention.

Referring now to FIGS. 27-29, another example of an assembly 2700 that utilizes a particulate filter or barrier is described. The assembly 2700 includes a base 2702, a lid 2704, a Microelectromechanical System (MEMS) apparatus 2708, and an integrated circuit 2710. Sound enters through the lid 2702 via a port 2706 into the MEMS apparatus 2708. The structure of the lid 2704 is described in greater detail below.

Generally speaking and as described elsewhere herein, each of the lid 2704 and base 2702 are formed of one or more layers of materials. For example, these components may be constructed of FR-4 boards and may have various conductive and insulating layers arranged around these boards.

Conductive traces (not shown) couple the output of the integrated circuit 2710 to conductive pads 2716 on the base. A customer can make an electrical connection with the pads 2716 for further processing of the signal that is received from the integrated circuit 2710.

The MEMS apparatus 2708 receives acoustic energy and transduces it into electrical energy. In that respect, the MEMS apparatus 2708 may include a diaphragm and a back plate. Sound energy causes movement of the diaphragm and this varies the charge between the diaphragm and the back plate. The resulting electrical signal that is produced represents the sound energy that has been received by the MEMS apparatus 2708. The MEMS apparatus 2708 is attached to the base by die attach adhesive 2711 or any other appropriate fastening mechanism or approach.

The integrated circuit 2710 is any kind of integrated circuit that performs any kind of processing function. In one example, the integrated circuit 2710 is a buffer or an amplifier. Other examples of integrated circuits are possible. Although only one integrated circuit is shown in this example, it will be appreciated that multiple integrated circuits may be deployed.

The lid 2704 is constructed from mesh metal 2721. The mesh metal 2721 is optionally covered with an epoxy 2723 (or some similar material) and allowed to harden to obtain a solid part. During manufacturing, the mask (or portion) of the epoxy 2723 that actually covers the port hole is selectively patterned or etched away leaving a mesh-covered port 2706 or opening and a solid lid. In some aspects, the mesh 2721 functions as a faraday cage, thereby providing radio frequency (RF) protection to the components of the assembly 2700. Enhanced RF protection may also be provided over previous approaches due to the port being covered by mesh. Particle ingress protection is provided by small (e.g., approximately 50 um or less) holes or openings in the mesh that defines the port hole 2706. It will be appreciated that the lid

2704 may be constructed completely with a mesh (it covers the entire lid) or partially with mesh (e.g., the mesh is utilized only at the top of the lid 2704). The metal mesh 2721 can also be coated with hydrophobic material to increase its resistance to liquid water penetration.

Figure 30:
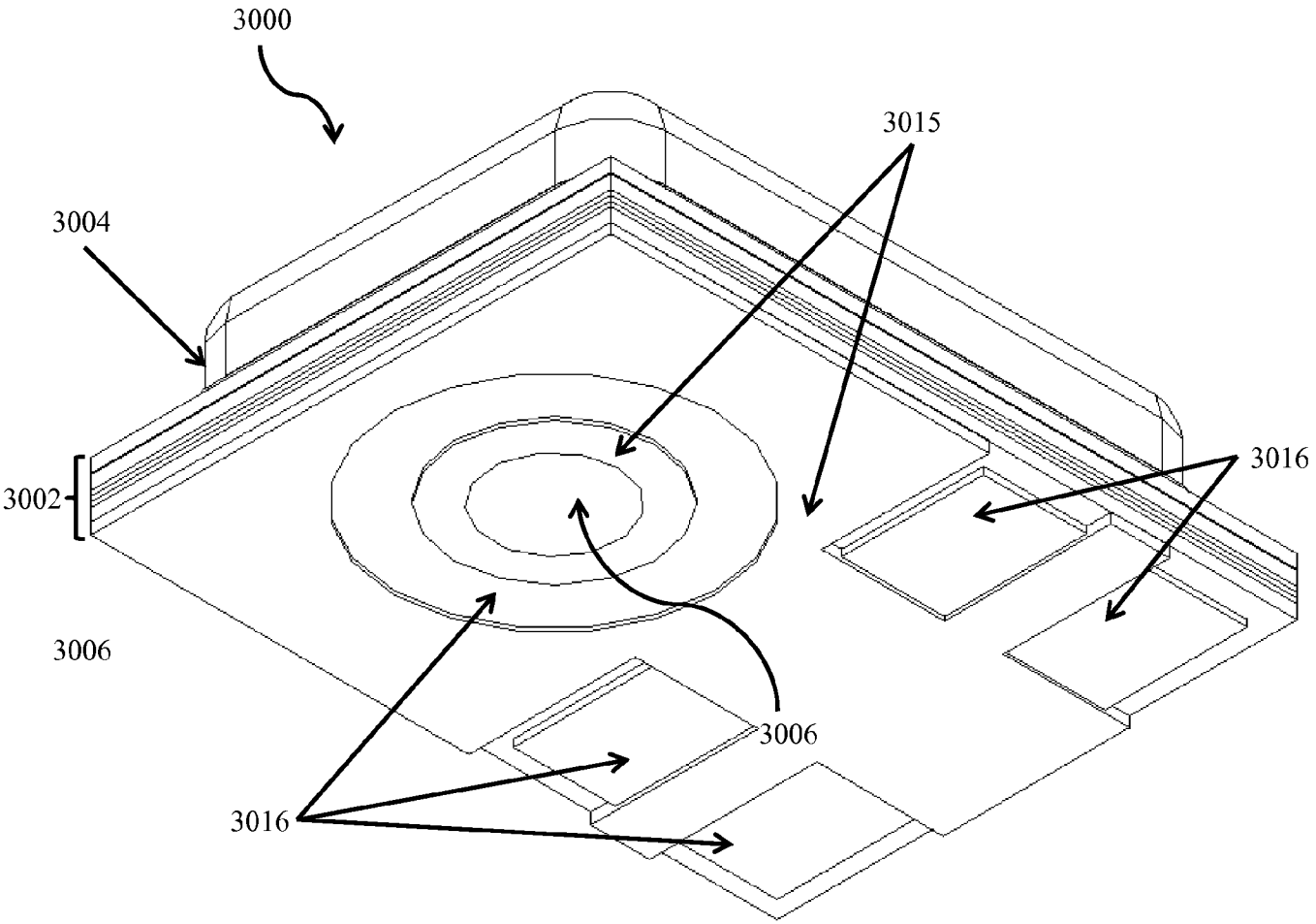
FIG. 30 comprises a perspective view of a MEMS assembly with barrier without a port according to various embodiments of the present invention.
Figure 31:
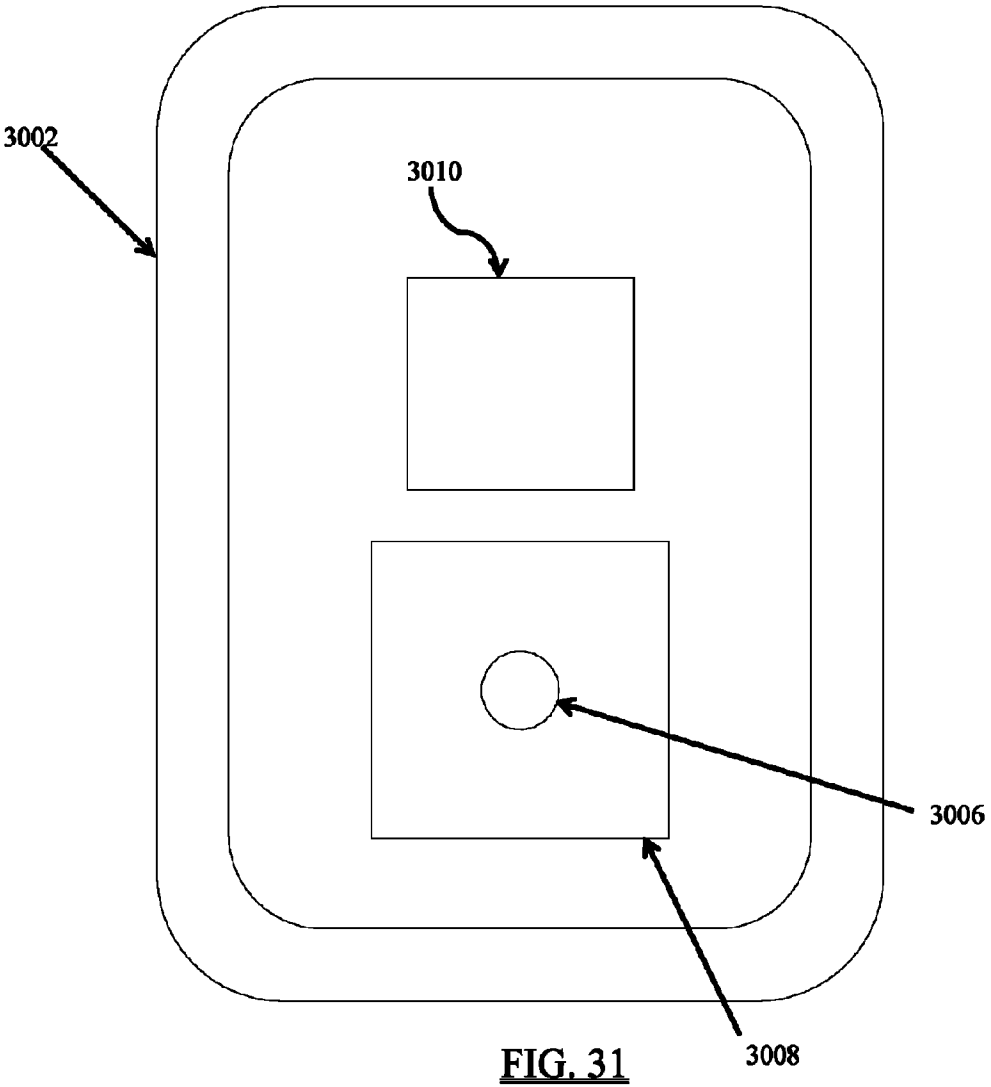
FIG. 31 comprises a top view of the base portion of the assembly of FIG. 27 according to various embodiments of the present invention.
Figure 32:
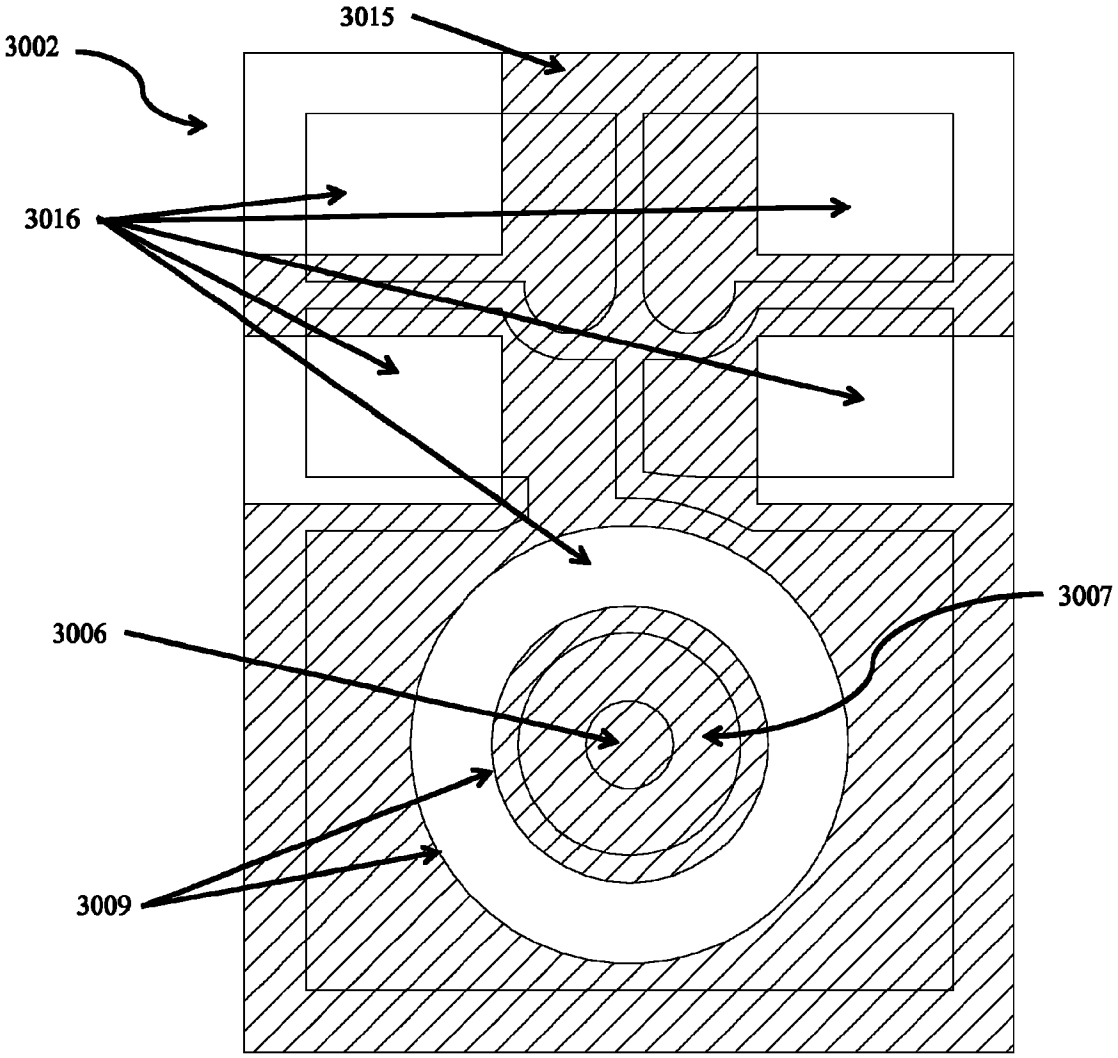
FIG. 32 comprises a bottom view of the barrier of FIGS. 30 and 31 according to various embodiments of the present invention.

Referring now to FIGS. 30-32, an example of a microphone assembly that uses a passivation or membrane layer is described. The assembly 3000 includes a base 3002 (with the passivation layer 3020), a lid 3004, a Microelectromechanical System (MEMS) apparatus 3008, and an integrated circuit 3010, and a port 3006. The structure of the base 3002 is described in greater detail below.

Generally speaking and as described elsewhere herein, each of the lid 3004 and base 3002 are formed of one or more layers of materials. For example, these components may be constructed of FR-4 boards and may have various conductive and insulating layers arranged around these boards.

Conductive traces (not shown) couple the output of the integrated circuit 3010 to conductive pads 3016 on the base. A customer can make an electrical connection with the pads 3016 for further processing of the signal that is received from the integrated circuit 3010.

The MEMS apparatus 3008 receives acoustic energy which is transduced into electrical energy. In that respect, the MEMS apparatus 3008 may include a diaphragm and a back plate. Acoustic energy causes movement of the diaphragm and this varies the charge between the diaphragm and the back plate. The resulting electrical signal that is produced represents the acoustic energy that has been received by the MEMS apparatus 3008. The MEMS apparatus 3008 is attached to the base by die attach adhesive (not shown) or any other appropriate fastening mechanism or approach.

The integrated circuit 3010 is any kind of integrated circuit that performs any kind of processing function. In one example, the integrated circuit 3010 is a buffer or an amplifier. Other examples of integrated circuits are possible. Although only one integrated circuit is shown in this example, it will be appreciated that multiple integrated circuits may be deployed.

The passivation or membrane layer 3015 replaces the solder mask layer of bottom port microphone assemblies. The layer 3015, for example, is a mechanically attached (e.g., using ultrasonic welding) insulating porous membrane (e.g., ePTFE) as the layer. The layer acts as a passivation layer to prevent solder flow between solder pads 3016 (which are defined by the ultrasonic weld/cut edge 3009). The layer 3015 provides protection against ingress foreign materials, both liquid and solid particulates, into the acoustic port since it covers the acoustic port 3006. The end result is a welded pattern film of porous polymer with openings for the solder pad but covering the port 3006 in the area 3007 that is not ultrasonically welded.

Figure 33:
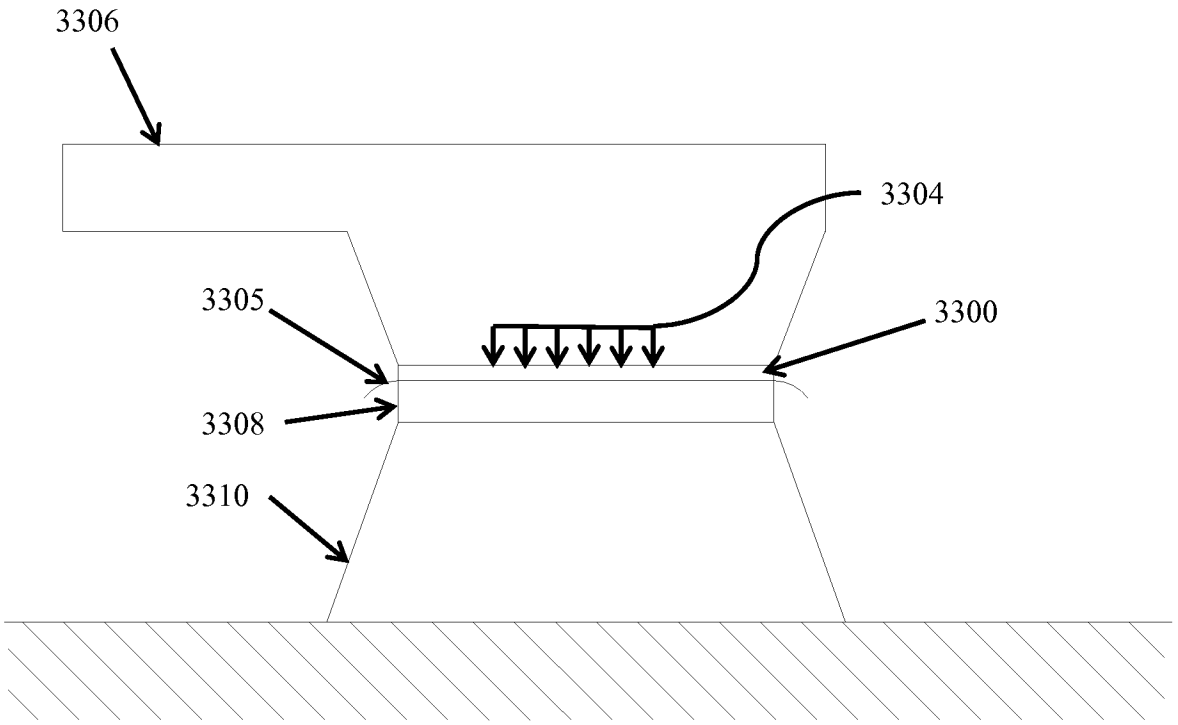
FIG. 33 comprises a drawing of a manufacturing approach for the assemblies of FIGS. 30-32 according to the present invention.

Referring now to FIG. 33, one example of an approach to manufacturing the devices of FIGS. 30-32 is described. A PCB panel 3300 includes an array of one or more microphone bases 3304. A porous polymer membrane 3305 is applied over the panel 3300. The PCB panel 3302 is disposed between a horn 3306 and tooling 3308 and the tooling 3308 rests on an anvil 3310. The function of the horn 3306 is to provide ultrasonic energy. The function of the tooling 3308 is to provide surfaces that weld and cut the porous membrane. The anvil 3310 supports the tooling 3308 to allow transfer of acoustic energy from the horn 3306.

Ultrasonic energy and pressure is applied to the horn 3306 and the horn 3306 transfers energy through the PCB panel 3300 causing the tooling 3308 to weld and simultaneously cut the porous polymer membrane 3305 to the panel 3300. In other words the tool 3308 cuts out/removes areas for solder pads but covers the port area. It will be appreciated that other manufacturing methods can also be employed.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A microphone assembly comprising:

a cover;

a base comprising:

a first material layer having an upper surface and a lower surface, and an acoustic port;

a second material layer disposed on the upper surface of the first material layer, wherein the second material layer has an opening that is larger than the acoustic port in the first material layer, and an axis of the opening in the second material layer is aligned with an axis of the acoustic port in the first material layer; and a barrier layer comprised of multiple ports, wherein the multiple ports are offset from the axis of the acoustic port, the barrier layer cooperating with the first and second material layers to form an internal cavity in the base;

wherein the multiple ports of the barrier layer and the acoustic port of the first material layer are acoustically coupled to the internal cavity, thereby providing a path for sound from the exterior of the microphone assembly;

a microelectromechanical system (MEMS) device having an internal chamber and disposed on the base, wherein the MEMS device is disposed such that its internal chamber is acoustically coupled to the multiple ports of the barrier layer; and a cover attached to the base, wherein the cover cooperates with the base to form an acoustic chamber for the MEMS device.

2. The microphone assembly of claim 1 further comprising an integrated circuit coupled to the MEMS device.

3. The microphone assembly of claim 2 wherein the integrated circuit is an application specific integrated circuit (ASIC).

4. The microphone assembly of claim 1, wherein the barrier layer has a hydrophobic coating.

5. The microphone assembly of claim 1, wherein the barrier layer comprises a patterned flex printed circuit board (PCB).

6. The microphone assembly of claim 5 wherein the patterned flex PCB comprises a polyimide film.

7. The microphone assembly of claim 1, wherein the multiple ports of the barrier layer are sized to limit the ingress of particulates into the acoustic chamber.

8. A microphone assembly comprising:

a base comprised of:

a first circuit board layer having a plurality of ports;

a second circuit board layer having an acoustic port; and a core layer of non-conductive material, the core layer having an opening formed at a predetermined location, wherein the first circuit board layer, the second circuit board layer, and the core layer, when joined together, cooperate to form an internal cavity, wherein the plurality of ports in the first circuit board layer and the acoustic port in the second circuit board layer are acoustically coupled to the internal cavity, thereby providing a path for sound from the exterior of the microphone assembly, and wherein the axes of the plurality of ports in the first circuit board layer and the axis of the acoustic port in the second circuit board layer are not aligned with each other;

a microelectromechanical system (MEMS) device disposed on the base, wherein an internal chamber of the MEMS device is aligned over the plurality of ports in the first circuit board layer such that the axis of the acoustic port is aligned with the axis of the internal chamber of the MEMS device; and a cover attached to the base, wherein the cover provides an acoustic chamber for the MEMS device.

9. The microphone assembly of claim 8, wherein the internal cavity has straight walls.

10. The microphone assembly of claim 8, wherein the internal cavity has a plurality of curved walls.

11. A microphone assembly comprising:

a base having an upper surface and a lower surface, the base further comprising an acoustic port;

a microelectromechanical system (MEMS) device having an internal chamber, wherein the MEMS device is disposed on the upper surface of the base and the internal chamber of the MEMS device is aligned with the acoustic port;

a barrier element disposed on the upper surface of the base and covering the acoustic port, wherein the barrier element is disposed within the internal chamber of the MEMS device, wherein the barrier element is porous to sound but does not allow particulates to pass through the acoustic port; and a cover attached to the upper surface of the base.

12. The microphone assembly of claim 11, wherein the barrier element comprises an elongated tunnel with a plurality of turns, wherein one port of the elongated tunnel is acoustically coupled to the acoustic port in the base, and the other port of the elongated tunnel is acoustically coupled to the internal chamber of the MEMS device.

13. The microphone assembly of claim 12, wherein the port of the elongated tunnel that is acoustically coupled to the acoustic port in the base has a diameter that is smaller than the diameter of the acoustic port.

14. The microphone assembly of claim 12, wherein the barrier element is comprised of silicon and the elongated tunnel is formed by one of stealth dicing or chemical etching.

15. The microphone assembly of claim 11, wherein the barrier element is a non-conductive material and comprises:

an internal channel;

a first trench opening disposed on a bottom side of the barrier element, the first trench opening acoustically coupled to the acoustic port in the base; and a second trench opening disposed on a top side of the barrier element, the second trench opening acoustically coupled to the internal chamber of the MEMS device, wherein the internal channel acoustically couples the first trench opening to the second trench opening, thereby allowing sound to reach the MEMS device through the acoustic port and substantially blocking particulates from passing through the acoustic port.

16. The microphone assembly of claim 15, wherein the internal channel of the barrier element is curved or straight.

17. The microphone assembly of claim 15, wherein the internal channel of the barrier element is formed by one of stealth dicing or chemical etching and the first and second trenches are formed by dry etching.

18. The microphone assembly of claim 11, wherein the barrier element is a non-conductive material and comprises:

a first trench traversing the length of a bottom surface of the barrier element, wherein the bottom surface of the barrier element is coupled to the upper surface of the base, the first trench acoustically coupled to the acoustic port in the base; and a second trench traversing the length of the bottom surface of the barrier element, the second trench acoustically coupled to the acoustic port in the base, wherein the first trench and the second trench intersect each other at a predetermined angle, and wherein acoustic pressure entering the microphone assembly is transferred through the first and second trenches and exits the barrier element through the respective trench openings in the sidewalls of the barrier element.

19. The microphone assembly of claim 18, wherein the first trench is a plurality of first trenches, and the second trench is a plurality of second trenches.

20. The microphone assembly of claim 18, wherein the respective openings of the first and second trenches in the sidewalls of the barrier element are acoustically coupled to the internal chamber of the MEMS device.

21. The microphone assembly of claim 11, wherein the barrier element is a porous ceramic material having pore sizes in the range of 1 to 100 microns.

22. The microphone assembly of claim 21, wherein the barrier element has pore sizes in the range of 2 to 20 microns.

23. The microphone assembly of claim 21, wherein the barrier element further comprises an impervious surface on a portion of a top surface of the barrier element.

24. A microphone assembly comprising:

a base;

a microelectromechanical system (MEMS) device disposed on the base; and a solid cover attached to the base and forming an acoustic chamber for the MEMS device, wherein the solid cover is comprised of:

a metal mesh layer having a predetermined shape with an interior surface and an exterior surface; and a layer of epoxy material covering the exterior surface of the metal mesh layer, wherein the epoxy material is patterned to form an acoustic port that exposes a portion of the underlying metal mesh layer, wherein the exposed portion of the metal mesh layer allows sound to pass there through but not allowing particulates to pass there through.

25. The microphone assembly of claim 24 further comprising an integrated circuit coupled to the MEMS device.

26. The microphone assembly of claim 24 wherein the integrated circuit is an application specific integrated circuit (ASIC).

27. The microphone assembly of claim 24, wherein the shaped metal mesh of the solid cover provides radio frequency protection for the MEMS device.

28. The microphone assembly of claim 24, wherein the exposed metal mesh in the acoustic port in the solid cover has openings of 50 microns or less.

29. The microphone assembly of claim 24, wherein the exposed metal mesh in the acoustic port in the solid cover is coated with a hydrophobic material.

30. A microphone assembly comprising:

a base;

a microelectromechanical system (MEMS) device disposed on the base; and a solid cover attached to the base and forming an acoustic chamber for the MEMS device, wherein the solid cover is comprised of:

a layer of epoxy material formed into a predetermined shape having an interior surface and an exterior surface, and having an acoustic port in an upper portion of the predetermined shape; and a layer of metal mesh disposed on the interior surface of the epoxy material layer, wherein the metal mesh layer completely covers the acoustic port and allows sound to pass through the acoustic port but not allowing particulates to pass through.

31. The microphone assembly of claim 30, further comprising an integrated circuit coupled to the MEMS device.

32. The microphone assembly of claim 31, wherein the integrated circuit is an application specific integrated circuit (ASIC).

33. The microphone assembly of claim 30, wherein the exposed metal mesh in the acoustic port in the solid cover has openings of 50 microns or less.

34. The microphone assembly of claim 30, wherein the exposed metal mesh in the acoustic port in the solid cover is coated with a hydrophobic material.

35. The microphone assembly of claim 30, wherein the porosity of the acoustic portion of the solid cover is controlled to dampen the frequency response of the microphone assembly.

36. A microphone assembly comprising:

a base;

a microelectromechanical system (MEMS) device disposed on the base; and a solid cover attached to the base and forming an acoustic chamber for the MEMS device, wherein the solid cover is comprised of:

sidewall portions comprised of a fused material without voids; and an acoustic portion comprised of a partially fused material containing voids, wherein the sidewall portions and the acoustic portion cooperate to provide the acoustic chamber, wherein the acoustic portion allows sound to pass there through but not allowing particulates to pass there through.

37. The microphone assembly of claim 36, further comprising an integrated circuit coupled to the MEMS device.

38. The microphone assembly of claim 37, wherein the integrated circuit is an application specific integrated circuit (ASIC).

39. The microphone assembly of claim 36, wherein the acoustic portion of the solid cover comprises a cover comprises partially fused or sintered metal.

40. The microphone assembly of claim 36, wherein the acoustic portion of the solid cover is coated with a hydrophobic material.

41. The microphone assembly of claim 36, wherein the sidewall portions and the acoustic portion of the solid cover are constructed from metal to provide protection against radio frequency interference for the MEMS device.

* * * * *